US007441751B1

(12) United States Patent
Gibbs

(10) Patent No.: US 7,441,751 B1
(45) **Date of Patent: *Oct. 28, 2008**

(54) CABLE FENCE SYSTEM

(76) Inventor: Edward L. Gibbs, 1555 N. Mingo Rd., Tulsa, OK (US) 74116

( * ) Notice: Subject to any disclaimer, the term of this patent is extended or adjusted under 35 U.S.C. 154(b) by 67 days.

This patent is subject to a terminal disclaimer.

(21) Appl. No.: 11/466,170

(22) Filed: Aug. 22, 2006

Related U.S. Application Data

(63) Continuation of application No. 10/764,788, filed on Jan. 26, 2004.

(60) Provisional application No. 60/509,026, filed on Oct. 6, 2003.

(51) Int. Cl.
*E04H 17/00* (2006.01)

(52) U.S. Cl. ..... 256/23; 256/1; 256/34; 256/65.14; 256/13.1

(58) Field of Classification Search ..... 256/1, 256/19, 21–23, 32, 34, 65.14, DIG. 5, 13.1; 52/223.1, 223.4, 223.8, 223.14
See application file for complete search history.

(56) References Cited

U.S. PATENT DOCUMENTS

| | | | |
|---|---|---|---|
| 16,419 | A | 1/1857 | Wickersham |
| 383,343 | A | 5/1888 | Coker |
| 426,558 | A | 4/1890 | Dithridge |
| 910,950 | A | 1/1909 | Noll |
| 991,603 | A | 5/1911 | Brooks |
| 1,848,246 | A | 3/1932 | Dowell |
| 1,857,435 | A | 5/1932 | Cole |
| 2,251,967 | A | 8/1941 | Yoder |
| D133,482 | S | 8/1942 | MacKenzie |
| 2,337,626 | A | 12/1943 | Sawyer |
| 2,520,313 | A | 8/1950 | Harris |
| 2,669,434 | A | 2/1954 | White |
| 2,907,552 | A | 10/1959 | Crone |
| 2,919,113 | A | 12/1959 | Cofield |
| 3,185,445 | A | 5/1965 | Broadway |
| 3,305,221 | A | 2/1967 | Kling |
| 3,307,833 | A | 3/1967 | Muller et al. |
| 3,342,007 | A | 9/1967 | Merson |

(Continued)

FOREIGN PATENT DOCUMENTS

DE 1684650 10/1969

(Continued)

OTHER PUBLICATIONS

British Standards Institute, "BS 1722, Part 12, Specification for Steel Palisade Fences", published 1999, United Kingdom, all pages.

(Continued)

*Primary Examiner*—Victor Macarthur
(74) *Attorney, Agent, or Firm*—Gary Peterson

(57) ABSTRACT

A high security fence which includes strengthening cables. The cables extend internally within the aligned rails of the fence, and through cable passageways formed in the posts which support the fence rails. The cables are anchored adjacent each end by a substrate. Anchors are installed on each end of the cable to resist pullout of the cable from the substrate, which may be a concrete-filled bollard post installed in a buried concrete deadman.

20 Claims, 16 Drawing Sheets

U.S. PATENT DOCUMENTS

| | | | | |
|---|---|---|---|---|
| 3,370,836 | A | | 2/1968 | Ashworth et al. |
| 3,390,865 | A | | 7/1968 | Jeho |
| 3,397,866 | A | | 8/1968 | Hockett |
| 3,698,224 | A | | 10/1972 | Saytes |
| 3,892,387 | A | | 7/1975 | Mann |
| 3,893,271 | A | * | 7/1975 | Kotlarz ..... 52/168 |
| 3,902,703 | A | | 9/1975 | Bouye |
| 4,044,513 | A | | 8/1977 | Deike |
| 4,047,355 | A | | 9/1977 | Knorr |
| 4,054,269 | A | | 10/1977 | Stabler |
| 4,066,244 | A | | 1/1978 | Yoho |
| 4,074,893 | A | | 2/1978 | Coltrin |
| 4,075,473 | A | | 2/1978 | Winston |
| 4,096,673 | A | | 6/1978 | Deike |
| 4,146,212 | A | | 3/1979 | Lerner |
| 4,183,505 | A | | 1/1980 | Maestri |
| 4,246,737 | A | | 1/1981 | Eiloart et al. |
| 4,289,302 | A | | 9/1981 | Montgomery |
| 4,369,953 | A | | 1/1983 | Greiner et al. |
| 4,455,806 | A | | 6/1984 | Rice |
| 4,501,411 | A | | 2/1985 | Otaki |
| 4,609,185 | A | | 9/1986 | Prater et al. |
| 4,723,759 | A | | 2/1988 | Patrick |
| 4,819,916 | A | | 4/1989 | Wun-chung |
| 4,858,383 | A | | 8/1989 | Kendig |
| 4,887,691 | A | * | 12/1989 | Rotondo ..... 181/210 |
| 4,896,864 | A | | 1/1990 | Nusbaum |
| 4,920,331 | A | | 4/1990 | Ver Loren van Themaat et al. |
| 4,928,928 | A | | 5/1990 | Bush et al. |
| 4,979,817 | A | | 12/1990 | Crisp, Sr. |
| 5,039,066 | A | | 8/1991 | Stacey |
| 5,136,813 | A | | 8/1992 | Gibbs et al. |
| 5,272,838 | A | | 12/1993 | Gibbs |
| 5,275,382 | A | | 1/1994 | Charbaut et al. |
| 5,345,723 | A | | 9/1994 | Gibbs |
| 5,415,380 | A | | 5/1995 | Sharp |
| 5,443,244 | A | | 8/1995 | Gibbs |
| 5,613,664 | A | | 3/1997 | Svalbe |
| 5,675,943 | A | | 10/1997 | Southworth |
| 5,685,665 | A | | 11/1997 | Lembo |
| 5,860,636 | A | | 1/1999 | Duncan et al. |
| 5,944,443 | A | | 8/1999 | Benedict |
| 5,971,365 | A | | 10/1999 | Pigott et al. |
| 6,061,991 | A | | 5/2000 | Dahl |
| 6,065,738 | A | | 5/2000 | Pearce et al. |
| 6,141,926 | A | | 11/2000 | Rossiter et al. |
| 6,176,043 | B1 | | 1/2001 | Gibbs |
| 6,190,085 | B1 | | 2/2001 | Johansson |
| 6,226,849 | B1 | | 5/2001 | Beck et al. |
| 6,254,064 | B1 | | 7/2001 | Gibbs |
| D465,856 | S | | 11/2002 | Givens et al. |
| D466,620 | S | | 12/2002 | Givens et al. |
| D467,669 | S | | 12/2002 | Givens et al. |
| D468,028 | S | | 12/2002 | Givens et al. |
| 6,545,246 | B2 | | 4/2003 | Kummle |
| 6,588,733 | B1 | | 7/2003 | Tremeer et al. |
| D479,004 | S | | 8/2003 | Perkins et al. |
| D479,883 | S | | 9/2003 | Gresham et al. |
| 6,672,569 | B2 | | 1/2004 | Deeley |
| 6,684,477 | B2 | * | 2/2004 | Crissey ..... 256/65.02 |
| 6,811,144 | B2 | | 11/2004 | Denman et al. |
| 6,811,145 | B2 | | 11/2004 | Gibbs et al. |
| 6,848,230 | B2 | | 2/2005 | Kopish |
| 6,863,264 | B2 | | 3/2005 | Johansson et al. |
| 6,874,765 | B2 | | 4/2005 | Deeley |
| 6,874,767 | B1 | | 4/2005 | Gibbs |
| 6,932,327 | B2 | | 8/2005 | Alberson et al. |
| 6,962,328 | B2 | | 11/2005 | Bergendahl |
| 6,969,051 | B1 | | 11/2005 | Gibbs |
| 7,071,439 | B2 | | 7/2006 | Gibbs et al. |
| D572,374 | S | | 7/2008 | Gibbs |
| 2002/0185639 | A1 | | 12/2002 | Galivan |
| 2003/0164487 | A1 | | 9/2003 | Deeley |
| 2003/0193047 | A1 | | 10/2003 | Wiley |
| 2003/0197163 | A1 | | 10/2003 | Deeley |
| 2005/0077507 | A1 | | 4/2005 | Heimbecker et al. |
| 2006/0017048 | A1 | | 1/2006 | Alberson et al. |
| 2006/0093430 | A1 | | 5/2006 | Bergendahl et al. |
| 2006/0145131 | A1 | | 7/2006 | Purvis |

FOREIGN PATENT DOCUMENTS

| | | | |
|---|---|---|---|
| DE | 1684647 | | 12/1969 |
| DE | 1709153 | | 7/1970 |
| EP | 172075 | A1 | 2/1986 |
| EP | 282269 | B1 | 1/1991 |
| EP | 443441 | B1 | 3/1994 |
| EP | 935038 | A1 | 8/1999 |
| EP | 949395 | A2 | 10/1999 |
| FR | 704320 | | 5/1931 |
| FR | 1539118 | | 9/1968 |
| FR | 2372296 | A1 | 6/1978 |
| FR | 2722820 | A1 | 1/1996 |
| GB | 1103873 | A1 | 2/1968 |
| GB | 1232494 | A1 | 5/1971 |
| GB | 1551154 | A1 | 8/1979 |
| GB | 2249327 | A1 | 6/1992 |
| GB | 2291081 | A | 1/1996 |
| GB | 2350846 | A1 | 12/2000 |
| GB | 2363400 | A1 | 12/2001 |
| GB | 02070838 | A1 | 9/2002 |
| GB | 2372758 | A1 | 9/2002 |
| GB | 2372759 | A1 | 9/2002 |
| WO | 9533113 | A1 | 12/1995 |
| WO | 9703266 | A1 | 1/1997 |

OTHER PUBLICATIONS

Ameristar Fence Products, Inc., "Aegis Ornamental Steel Residential Fencing," pp. 1-8, published in the United States no later than Apr. 2001.

Ameristar Fence Products, Inc., "Aegis II Industrial & Aegis Plus Commercial Ornamental Steel Fence and TransPort Ornamental Gates," pp. 1-18, published in the United States in Aug. 2000.

Ameristar Fence Products, Inc., "Tired of the Threats?," pp. 1-12, published in the United States in Aug. 2002.

Ameristar Fence Products, Inc., "2002 Price Catalog," all pages, published in the United States by at least Nov. 1, 2001 (prices redacted).

* cited by examiner

CABLE FENCE SYSTEM

CROSS-REFERENCE TO RELATED APPLICATIONS

This application is a continuation of U.S. patent application Ser. No. 10/764,788, filed Jan. 26, 2004, which claims priority on the basis of the filing dates of provisional U.S. Patent Application Ser. No. 60/509,026, filed Oct. 6, 2003, and nonprovisional U.S. patent application Ser. No. 10/306,125, filed Nov. 27, 2002 now U.S. Pat. No. 6,874,767, the latter of which in turn claims priority on the basis of provisional U.S. Patent Application Ser. No. 60/370,372, filed Apr. 5, 2002. The disclosures of these applications are incorporated by reference in their entirety.

FIELD OF THE INVENTION

The present invention relates generally to barriers to pedestrians or vehicles, and more particularly to fences which utilize one or more reinforcing cables.

SUMMARY OF THE INVENTION

The present invention comprises a fence formed from a first plurality of posts. A first rail system is supported by the first plurality of posts so as to form a barrier between each adjacent pair of the first plurality of posts. The first rail has a first end and an opposed second end system, and has a longitudinal internal recess formed therein. The fence further comprises a first rail cable assembly comprising a first cable having a first end and opposed second end. The first cable extends within at least a portion of the internal recess of the first rail system. A first anchor substrate situated adjacent the first end of the first rail system anchors the first cable adjacent its first end and a second anchor substrate situated adjacent the second end of the first rail system anchors the first cable adjacent its first end.

In another aspect, the present invention comprises a fence kit, comprising a plurality of posts and a plurality of rails, with each rail having a longitudinal internal recess formed therein within which a cable may extend. The kit further comprises a first cable extensible within the internal recess of each rail, and a first pair of anchors, each anchor attachable to the first cable.

The present invention further comprises a tubular post having an elongate lateral portion, the lateral portion having a first anchor slot formed therein, sized to clearingly receive an anchor therethrough.

The present invention also comprises a method of assembling a fence on a terrain from a first cable having a first end and an opposed second end. A plurality of intermediate posts are vertically positioned at spaced locations, and a first rail system is installed, so as to form a barrier between each adjacent pair of the intermediate posts. The first rail system has a longitudinal internal recess formed therein. The first cable is extended so that its medial portion extends within the internal recess of the first rail system, a first anchor is attached to the first cable adjacent its first end, and a second anchor is attached to the first cable adjacent its second end. A hard substrate which surrounds at least a portion of the first anchor is formed, and a hard substrate which surrounds at least a portion of the second anchor is formed.

BRIEF DESCRIPTION OF THE DRAWINGS

FIG. 9 is perspective view of the upper portion of an upright post of the present invention. One of the flanges has been removed in order to permit better display of other components.

FIG. 16 is a front elevational view of the first bollard post of the fence shown in FIG. 1, and its supporting first bollard substrate. The panel by the first bollard post has been omitted, in order to better display other fence components.

FIG. 18 is a side cross-sectional view of the first bollard post shown in FIG. 16, and its supporting first bollard substrate, taken along line 18-18. The second rail cable assembly has been partially cut away, in order to better display other components.

FIG. 19 is a front cross-sectional view of the second bollard post shown in FIG. 17, and its supporting second bollard substrate, taken along line 19-19. The rail cable assembly adjoining the first rail cable assembly has been partially cut away within the second bollard post, in order to better display other components.

DETAILED DESCRIPTION OF THE INVENTION

Figure 1:
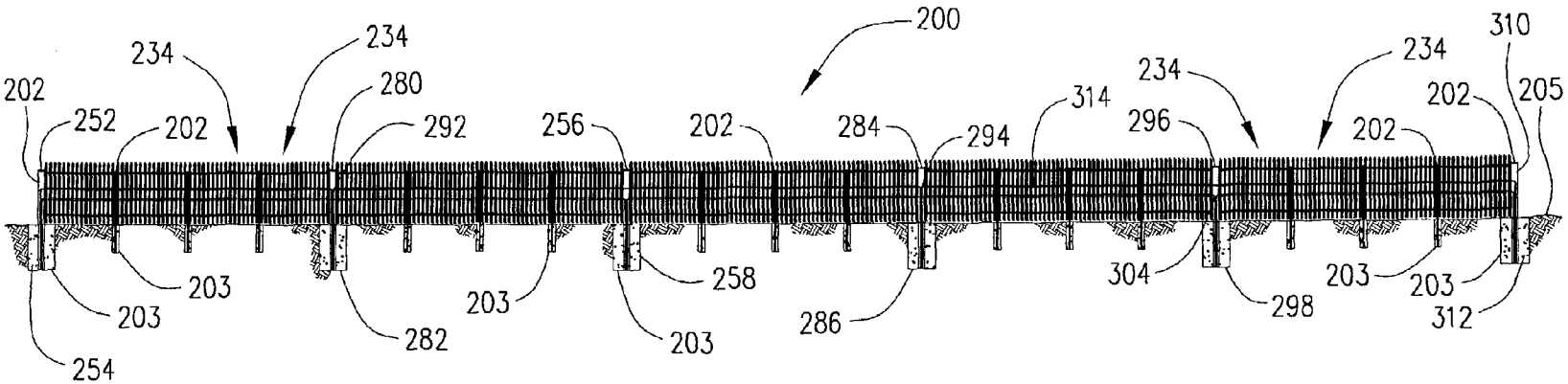
FIG. 1 is a front elevational view of a section of the fence of the present invention. The supporting terrain and substrates are shown in cross section. The bollard posts are shown cross-sectionally, with pickets removed, in order to better display other components.
Figure 2:
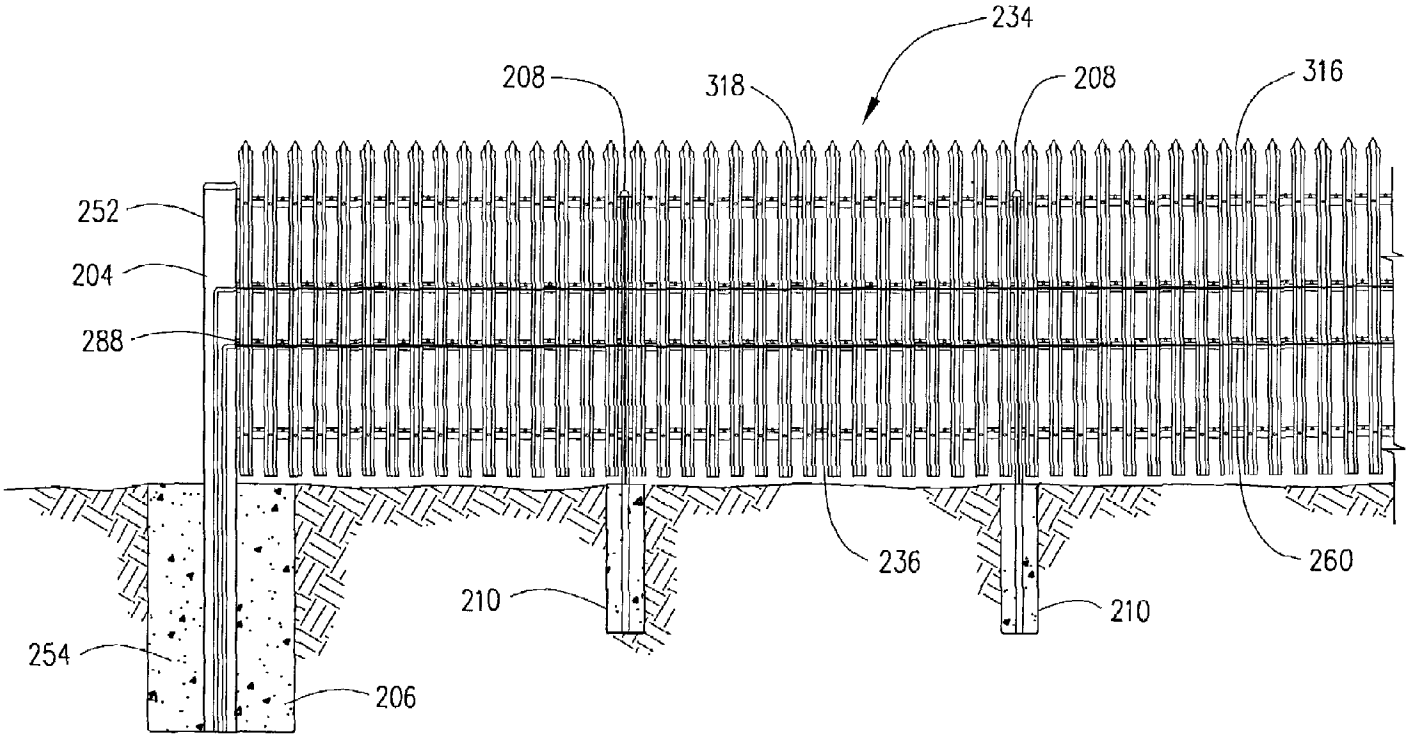
FIG. 2 is an enlarged and detailed front elevational view of the first end of the section of fence shown in FIG. 1. Portions of the fence have been cut away to shown the positioning of strengthening cables.
Figure 3:
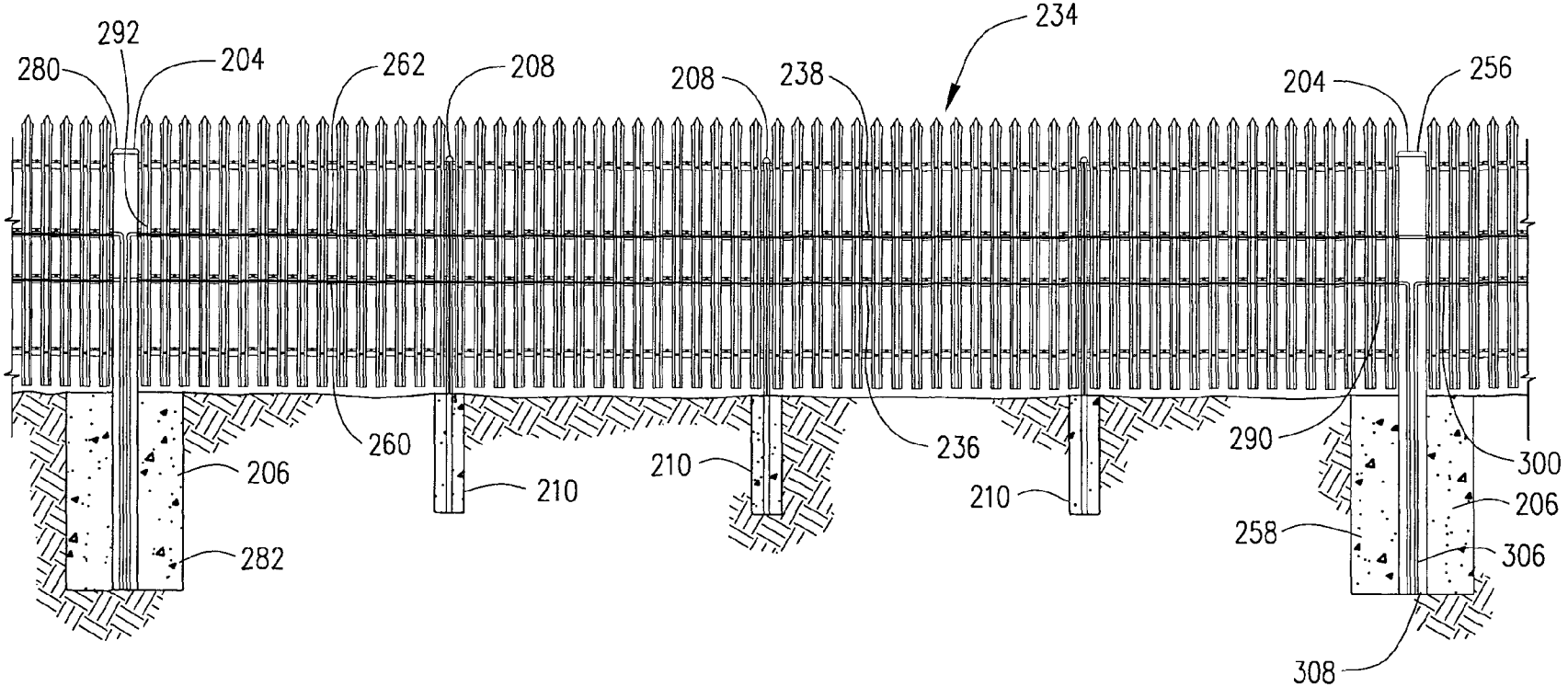
FIG. 3 is an enlarged and detailed front elevational view of the central portion of the section of fence shown in FIG. 1. Portions of the fence have been cut away to shown the positioning of strengthening cables.

With reference to FIGS. 1, 2 and 3, the present invention comprises a high security fence generally designated by reference numeral 200. The fence 200 comprises a plurality of spaced vertical posts 202, grouped into subpluralities as described hereafter. Each of the posts 202 is securely anchored at its base 201 into a substrate 203, such as an underground mass of concrete. Preferably, a concrete with relatively high compressive strength, such as 6,000 pounds per square inch, is used to form each of the substrates 203. Each post 202 should have a length sufficient to permit at least the lower three feet thereof to be received within substrate 203. The substrates 203 are preferably disposed in spaced relationship, with a separate substrate preferably supporting each post 202, as shown in FIG. 1.

The posts 202 are situated along the boundary of the area to be enclosed by the fence 200, with a post spacing which is adequate to impart strength to the fence 200 and to securely anchor other fence components. The height of each post 202 above terrain 205, in its installed configuration, preferably equals or exceeds the height of a human or other intruder. In one preferred embodiment, the above-ground height of each post 202 is 6 feet. In another embodiment, the above-ground height of each post 202 is at least 8 feet. The upper end of each post 202 is preferably formed into a pointed or sharpened configuration 18 which will deter and hinder climbing. Alternately, a spear or spike may be installed at the upper end of the each post. In another embodiment, the posts 202 may be characterized by rounded or flattened tops.

The posts 202 forming the fence 200 are preferably arrayed along a line or curve. A plurality of spaced bollard posts 204, each of identical size and construction, preferably serve as terminal posts in the fence 200. Each bollard post 204 is supported by a bollard substrate 206. The bollard substrate 206 is preferably situated at least partially underground, and more preferably comprises an underground concrete mass (deadman) which fills a hole having a depth of at least 5 feet and a diameter of at least 3 feet.

Each of the bollard posts 204 is of tubular construction, and preferably is formed from a strong and durable material, such as a strip of sheet steel. In a preferred embodiment of the present invention, the steel is characterized by a thickness of 0.25 inches. In order to enhance its resistance to corrosion, this steel is preferably subjected to a pre-galvanizing treatment. The pre-galvanized steel is then subjected to a cold rolling process to produce a tubular shape. After cold rolling is complete, a polyester powder coating is preferably provided in order to further enhance corrosion resistance of the bollard post.

As best shown in FIG. 18, each bollard post 204 preferably has an end-to-end length of 11 feet, and a tubular shape characterized by two opposed ends and an elongate lateral portion having a circular or rectangular cross-section. Most preferably, the bollard post 204 is characterized by a square cross-section with each side having a length of 8 inches. At least one end of the tubular ends of bollard post 204 preferably is open, and selectively closable with a removable cap 232.

At least one, and preferably an opposed pair of anchor slots, each preferably rectangular in shape, is formed on the lateral portion of the bollard post 204, preferably by laser cutting or by stamping. The opposed anchor slots are preferably aligned along a line which passes through the longitudinal axis of the bollard post 204. the More preferably, plural opposed pairs of anchor slots are formed at longitudinally spaced locations on the lateral portion of the bollard post 204. In general, the plural number of anchor slot pairs formed in each the bollard post 204 preferably is equal to the number of cable assemblies to be received in each panel of the fence 200.

Figure 17:
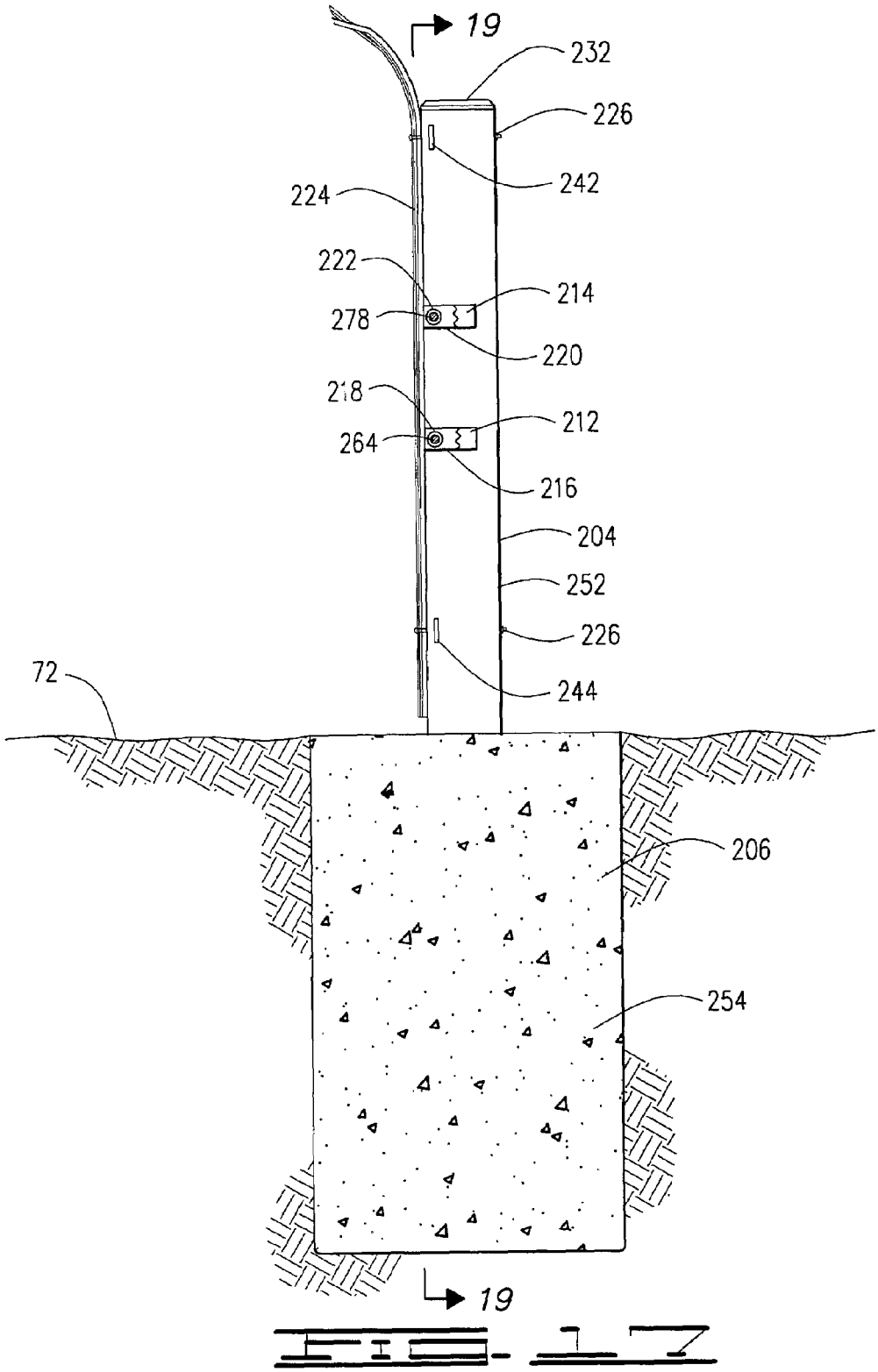
FIG. 17 is a side view of the first bollard post shown in FIG. 16, and its supporting first bollard substrate, taken along line 17-17. The slot covers are partially cut away to show the underlying anchor slots.
Figure 1:
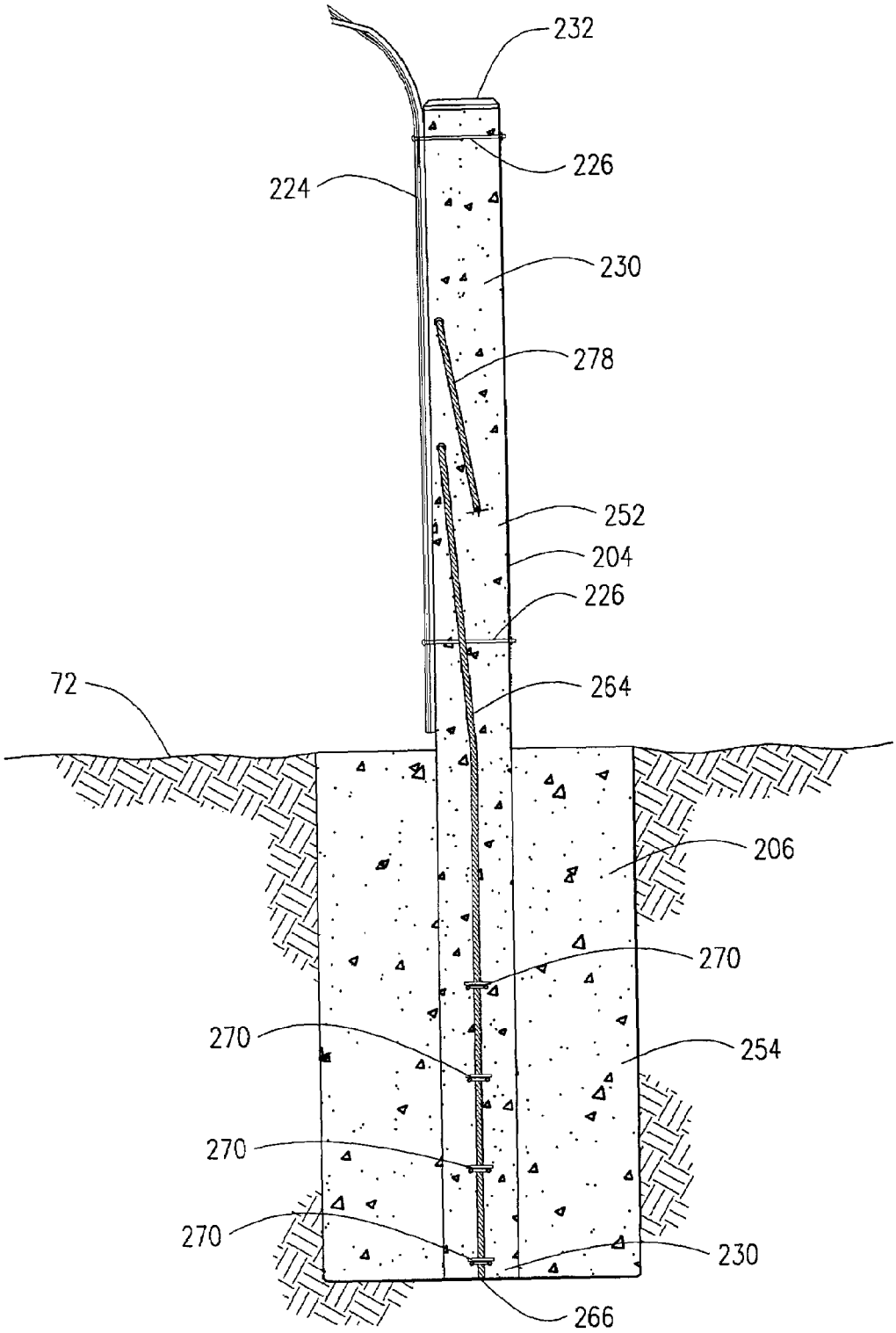
Figure 15:
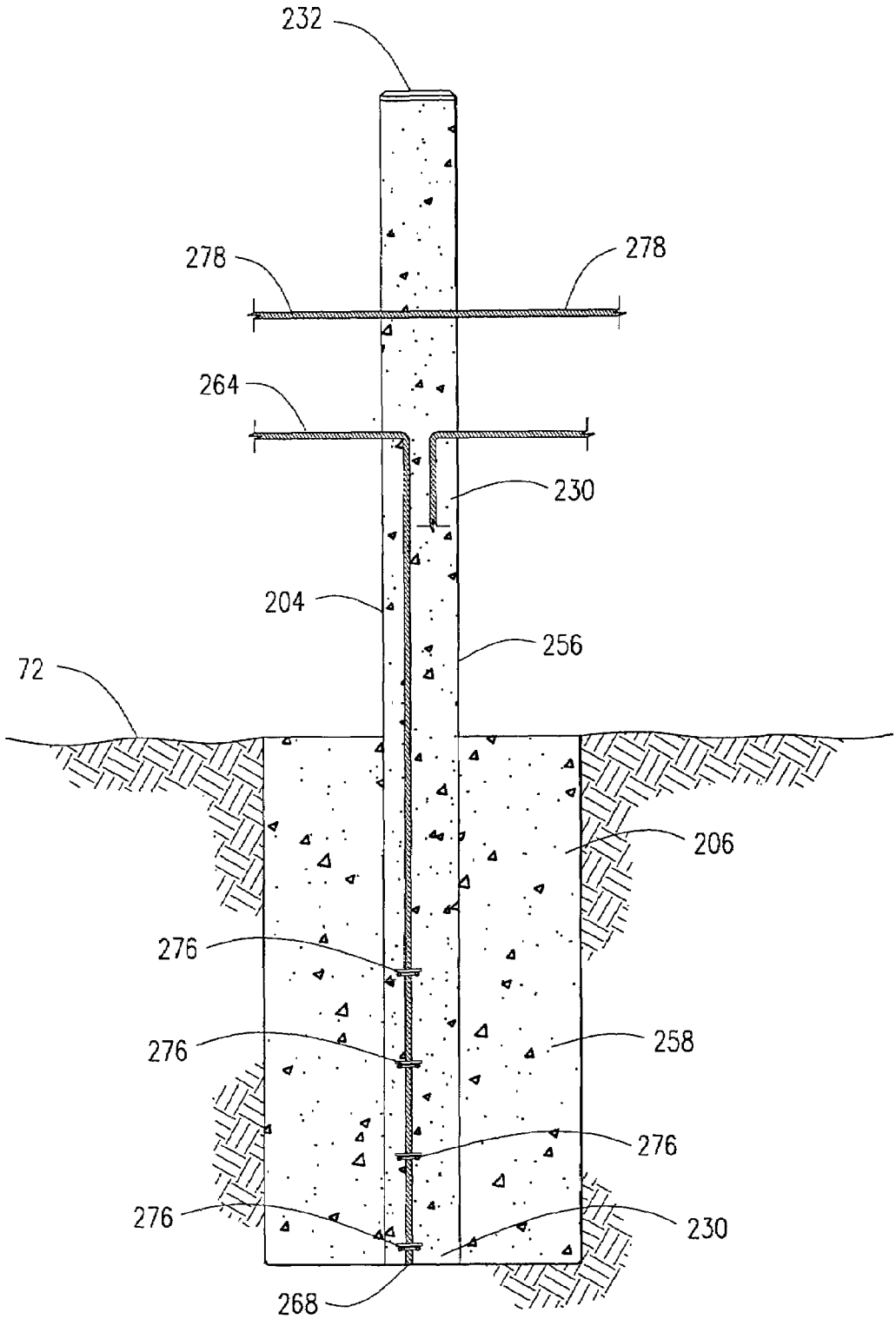

In the embodiment shown in FIG. 17, a first anchor slot 212 and second anchor slot 214 are on two opposite side faces of the bollard post 204. If cable assemblies are to extend through the side of the bollard post 204 opposite that shown in FIG. 17, then a second pair of anchor slots, which register with the first and second anchor slots 212 and 214, is preferably similarly formed at an opposed position on the side section. Each of the anchor slots 204 has cross-sectional dimensions which are sufficient to closely but clearingly receive an anchor assembly of a type to be described hereafter.

Each anchor slot is selectively closable by a slot cover, preferably substantially rectangular in shape and having dimensions which exceed those of the anchor slot. The anchor slot is preferably sized to overlay and cover the entire anchor slot, or at least a substantial portion of the anchor slot. Each slot cover is preferably formed from the same material as the bollard post 204 and is preferably characterized a cable opening formed therein.

The cable opening is sized to closely but clearingly receive all or part of a strengthening cable. The cable opening may be formed in a central portion of the slot cover, as shown in the Figures, or it may comprise a notch formed in an edge of the slot cover. The notch is preferably semicircular, and characterized by a radius which matches that of the first cable 264. Approximately one-half of the cross-sectional profile of the first cable 264 is receivable within the notch.

Each of the slot covers may be secured to the side of the bollard post in which a slot is formed by connectors (not shown), such as bolts. In the side of the bollard post 204 shown in FIG. 17, a first slot cover 216, having a first cable opening 218, covers the first anchor slot 212, while a second slot cover 220, having a second cable opening 222, covers the second anchor slot 214. A single connector (not shown), such as a bolt which traverses the bollard post 204, may be used to connect the anchor covers for two opposed anchor slots to the bollard post 204.

With reference to FIGS. 16-18, a picket 224, preferably identical in size and construction to the pickets 43 to be described hereafter, is secured to a side 225 of the bollard post 204 in which anchor slots are not formed, such that the picket 224 overlays a substantial portion of the bollard post 204, extending in a parallel relationship to its longitudinal axis. The picket 224 is secured to the bollard post 204 by a plurality of connectors 226, such as bolts. The connectors 226 preferably extend through the bollard post 204, as shown in FIG. 18.

As shown in FIGS. 18 and 19, each bollard post 204 is filled at least partially, and preferably completely, with a ballast 230. A preferred ballast is the same material from which the bollard substrates 206 are formed, namely concrete with a relatively high compressive strength, such as 6,000 pounds per square inch. The ballast 230 should be characterized by a uniform distribution and consistency within the interior of the bollard post 204.

In the embodiment shown in FIGS. 1-23, a first plurality of posts forming the fence 200 comprises spaced first and second bollard posts 252 and 256, which serve as terminal posts, and at least one, and preferably a plurality of intermediate posts situated between the first and second bollard posts 252 and 256. In the embodiment shown in FIGS. 1-3, the number of posts 202 in the first plurality is 9.

The first bollard post 252, which comprises one of the bollard posts 204, is supported by a first bollard substrate 254, which comprises one of the bollard substrates 206. The fence 200 further comprises a second bollard post 256, shown in FIG. 19, also comprising one of the bollard posts 204. The second bollard post 256, is positioned at a location spaced from the first bollard post 252 and is supported by a second bollard substrate 258, comprising one of the bollard substrates 206. The second bollard substrate 258 is preferably identical in size and configuration to the first bollard substrate 254.

Figure 12:
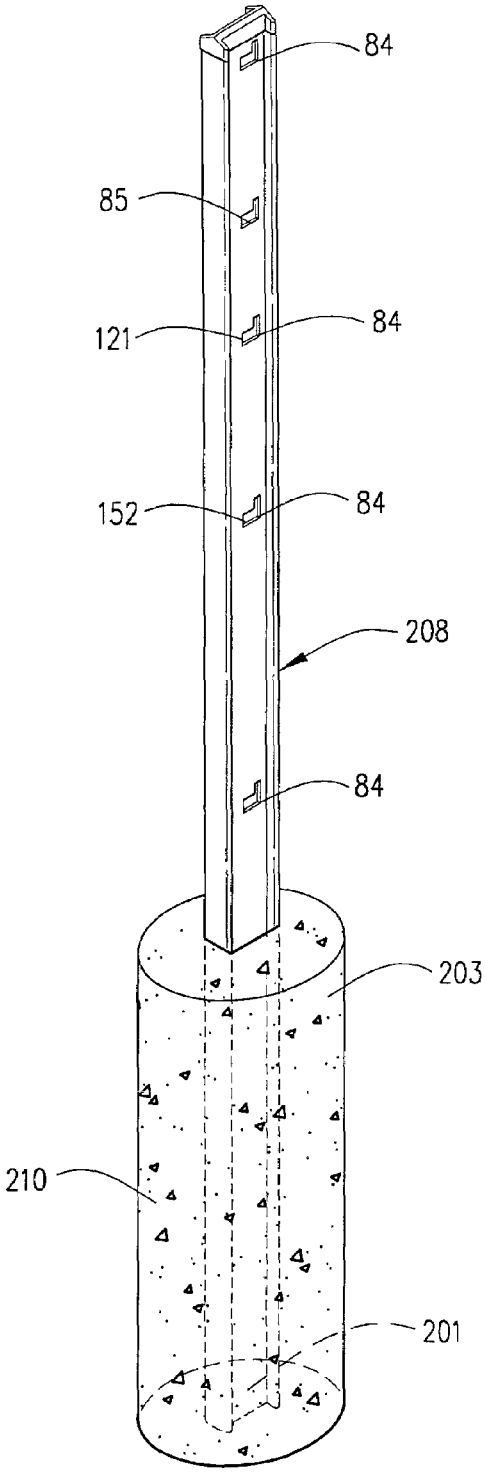
FIG. 12 is a perspective view of the upright post shown in FIG. 5, in an installed configuration.
Figure 15:
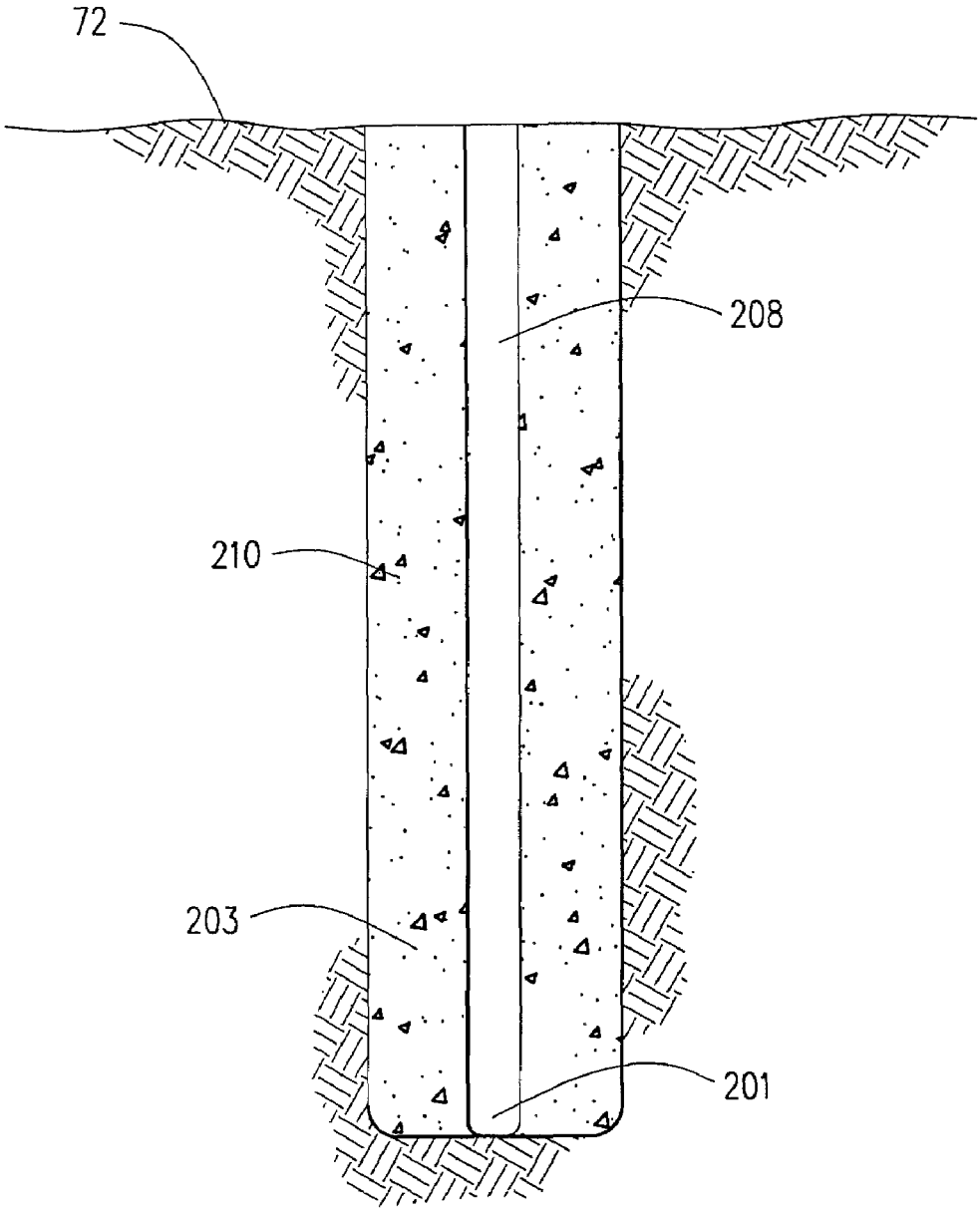
FIG. 15 is a cross-sectional view of one of the upright post substrates of the fence shown in FIG. 1, showing the base of an upright post.
Figure 1:
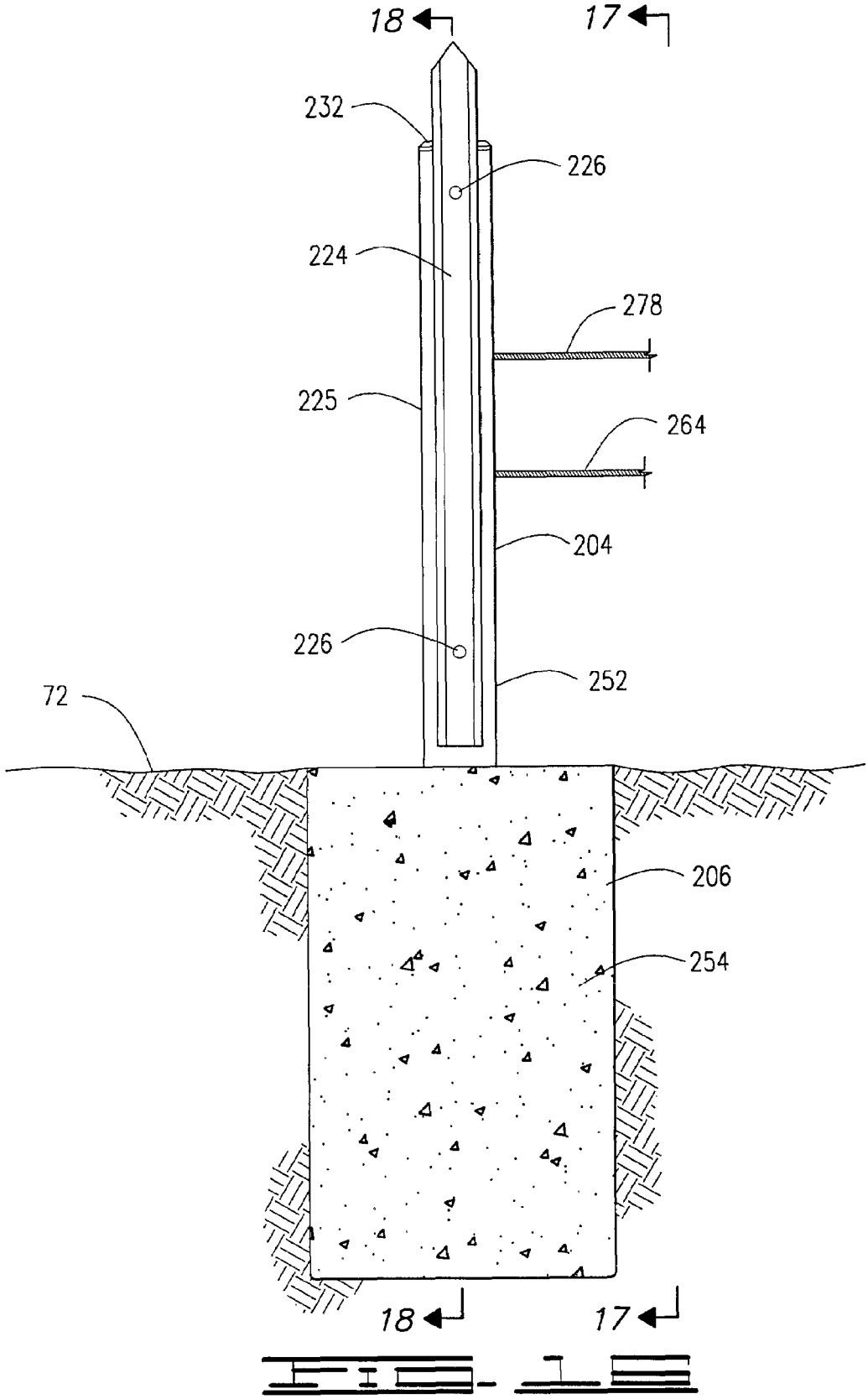

The posts 202 forming the fence 200 preferably further comprise a plurality of intermediate posts, situated between the spaced first and second bollard posts 252 and 256. Each of the intermediate posts is supported by an intermediate post substrate. Most of the intermediate posts preferably comprise unballasted upright posts 208 having the size and construction to be described hereafter. However, any one or more of the intermediate posts may comprise a bollard post 204. When an intermediate post comprises a bollard post 204, its supporting intermediate post substrate should comprise a bollard substrate 206. When an intermediate post is configured like one of upright posts 208, it is preferably supported by a upright post substrate 210, one of which is shown in FIGS. 12 and 15. Each of the upright post substrates 210 preferably comprises an underground mass of concrete which fills a hole having a depth of at least 3 feet and a diameter of at least 9 inches.

Each of the upright posts 208 is preferably formed from a strong and durable material, such as a strip of sheet steel. In a preferred embodiment of the present invention, the steel is characterized by a thickness of 0.1 inches. In order to enhance its resistance to corrosion, this steel is preferably subjected to a pre-galvanizing treatment. The pre-galvanized steel is then subjected to a cold rolling process to produce the cross-sectional shape shown in FIG. 5. After cold rolling is complete, a polyester powder coating is preferably provided in order to further enhance corrosion resistance of the post.

Figure 5:
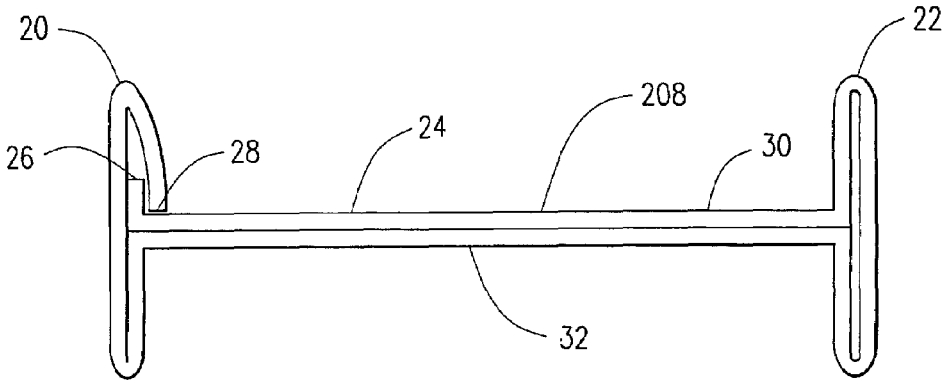
FIG. 5 is a top plan view of one embodiment of an upright post of the present invention.

As best shown in FIGS. 5 and 9, each upright post 208 is preferably characterized a pair of opposed flange sections 20 and 22 which are joined by flat web section 24. The opposite lateral edge portions 26 and 28 of the sheet steel used to form the upright post 208 are preferably folded into an overlapping and abutting configuration. This overlapping configuration improves resistance to corrosion and enhances the strength of the upright post 208.

The flange sections 20 and 22 are each characterized by a substantially flat double-wall structure. The flat web section 26 is a double-walled structure formed from abutting planar section 30 and 32. In the preferred embodiment shown in FIGS. 5 and 9, the web section 26 is 4 inches in width, while the flange sections 20 and 22 are each 1.75 inches in length.

Figure 6:
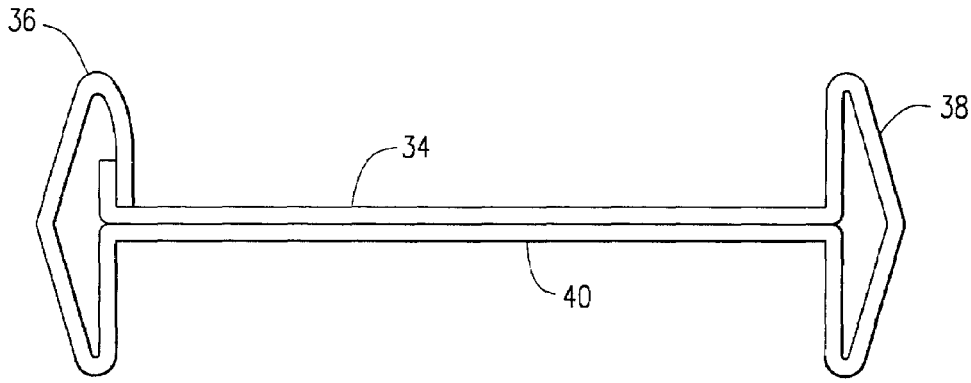
FIG. 6 is a top plan view of another embodiment of the upright post of the present invention.

FIG. 6 shows an alternative embodiment of the upright post of the present invention, designated by reference numeral 34. Much like the embodiment shown in FIGS. 5 and 9, the upright post 34 is characterized a pair of opposed flange sections 36 and 38, which are joined by flat web section 40. The flange sections 36 and 38 are each characterized by a triangular cross-section, with the triangular bends serving to strengthen of the flange sections 36 and 38 against lateral loading. Other features of the upright post 34 are identical to those described with reference to FIGS. 5 and 9.

One or more vertically spaced cable passageways, sized to closely but clearingly receive a strengthening cable, extend through each of the intermediate posts of the first plurality. If the intermediate post is an upright post 208, spaced first and second cable passageways 121 and 152, shown in FIG. 12, are preferably formed. If the intermediate posts comprise bollard posts 204, the first cable passageway therethrough preferably comprises a linear passage through the ballast 230 which registers at each of its ends with a first cable opening 218. The second cable passageway through a bollard post 204 preferably comprises a linear passage through ballast 230 which registers at each of its ends with a second cable opening 222.

With reference to FIGS. 1-3, the fence 200 preferably further comprises a plurality of panels 234, preferably of identical size and construction. The panels 234 may be pre-assembled at a manufacturing facility, or may be assembled at the site at which the fence 200 is to be installed. Each panel 234 is supported by, and extends between, and adjacent pair of posts 202 comprising the first plurality of posts.

The spacing of each adjacent pair of posts 202 should be sufficient to closely, but clearingly receive a panel 234. In one preferred embodiment, adjacent upright posts 208 are separated by a distance of 8 feet, while each bollard post 204 is separated from an adjacent upright post 208 by a distance of 8 feet, 4 inches. Adjoining bollard posts 204, if any, are separated by a distance of 8 feet, 8 inches. Preferably, each bollard post 204 is immediately adjoined on each of its sides by a series of upright posts 208. In one preferred embodiment, shown in FIGS. 1-3, a series of three adjacent upright posts 208 is situated on both sides of each bollard post 204.

The total separation distance between the first and second bollard posts 252 and 256 is preferably sufficient to permit the bollard posts 252 and 256 and intermediate posts to support an integral number, greater than one, of panels 234. A preferred total separation distance, illustrated in FIGS. 1-3, permits installation of eight panels 234 between the first and second bollard posts 252 and 256.

Figure 4:
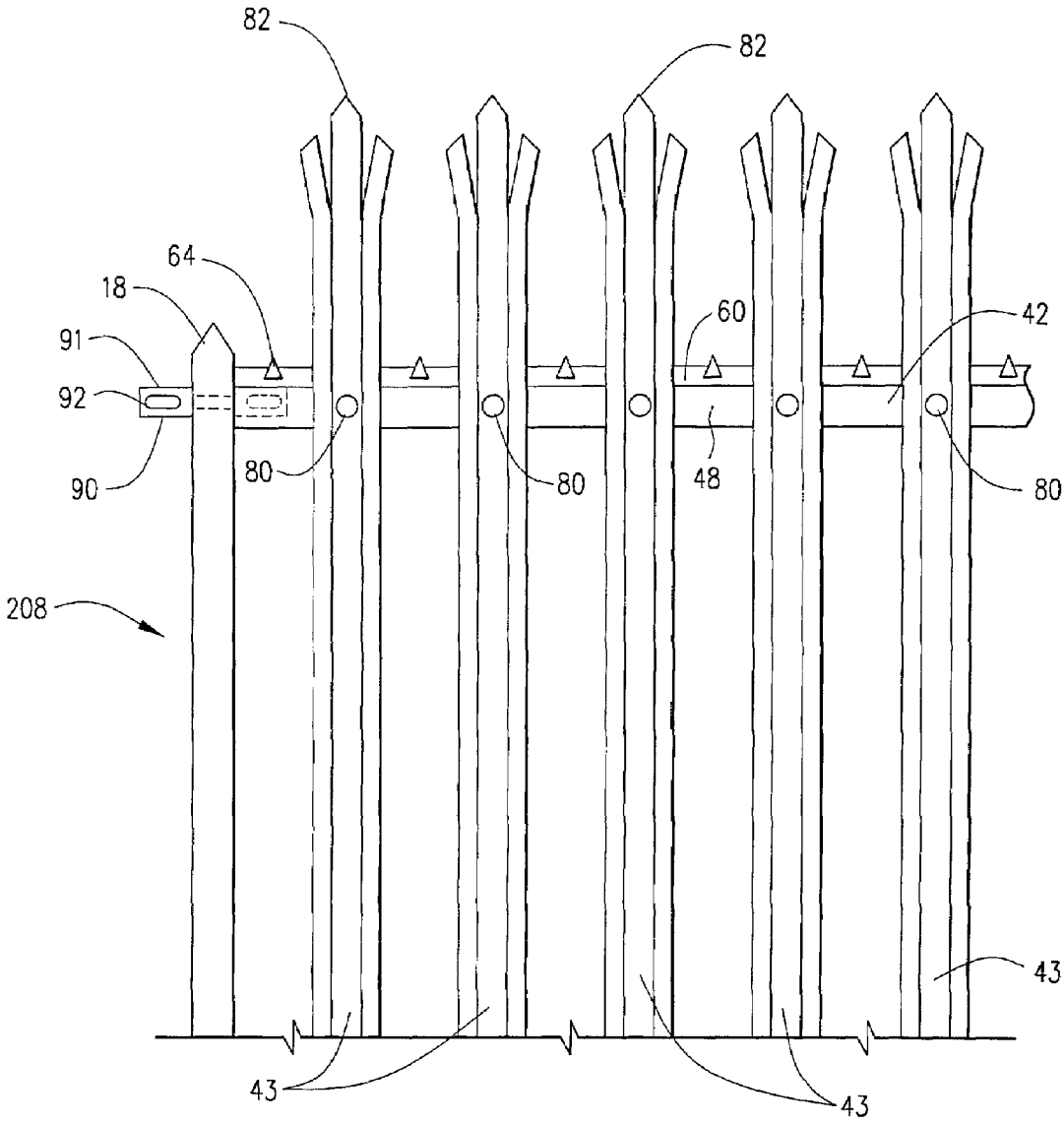
FIG. 4 is an enlarged and detailed front elevational view of the section of fence shown in FIG. 1, showing the upper portion of one of the upright posts, the adjacent pickets and the upper rail.
Figure 7:
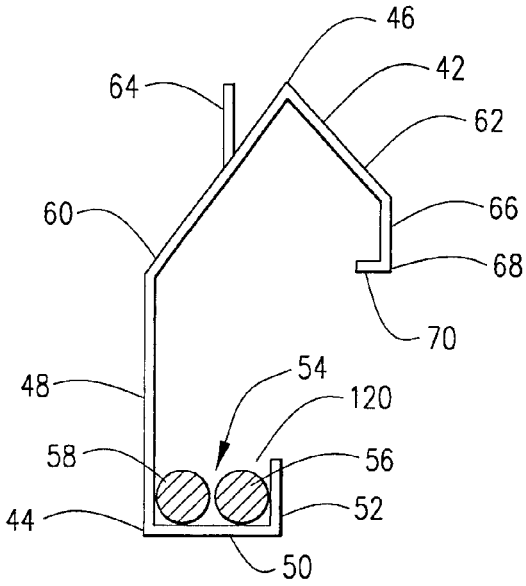
FIG. 7 is a cross-sectional view of the fence rail of the presence invention. Two parallel strengthening cables are shown in an installed position within the internal tray of the rail.
Figure 8:
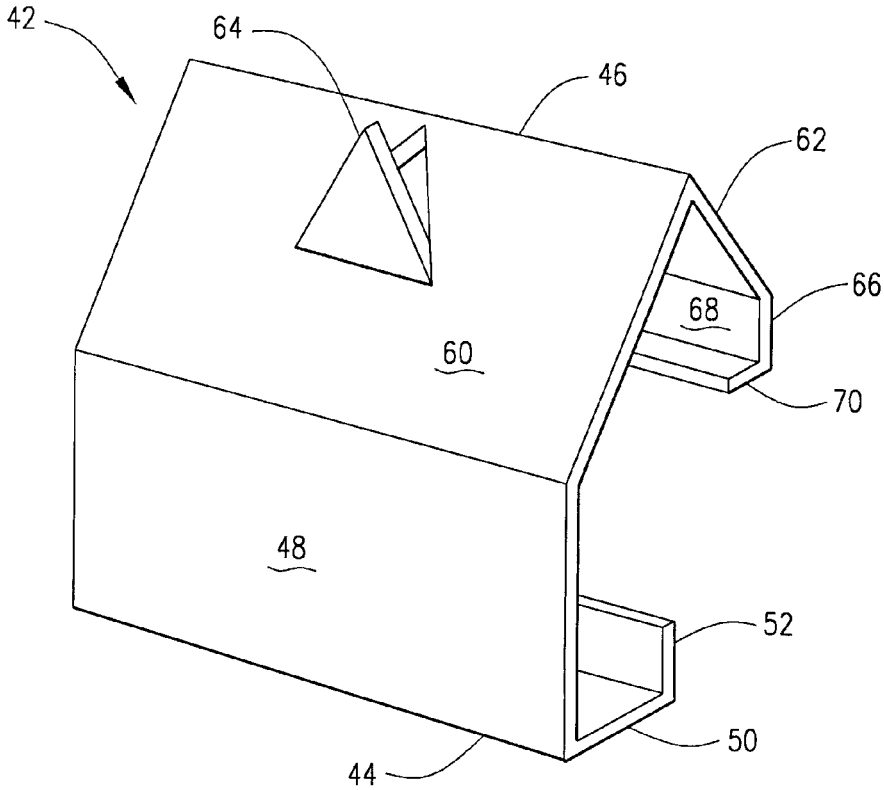
FIG. 8 is a perspective view of a portion of the fence rail of the present invention.
Figure 3:
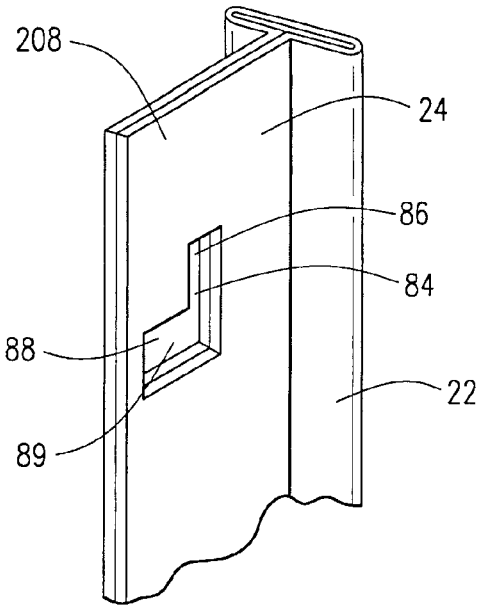

With reference to FIGS. 4, 7 and 8, each rail 42 is preferably formed from a strong and durable material, such as a strip of sheet steel. In a preferred embodiment of the present invention, the steel is characterized by a thickness of 0.1 inches. In order to enhance its resistance to corrosion, this steel is preferably subjected to a pre-galvanizing treatment. The pre-galvanized steel is then subjected to a cold rolling process to produce the cross-sectional shape shown in FIG. 7. After cold rolling is complete, a polyester powder coating is preferably provided in order to further enhance corrosion resistance of the rail 42. The length of each rail 42 should be sufficient to fully span the distance between the adjacent of pair of posts 202. The rails 42 comprising each panel 234 are preferably of identical size and construction. One preferred rail length is 8 feet, which results in a width for panel 234 of 8 feet.

As best shown in FIGS. 7 and 8, the rail 42 is characterized by a lower section 44 and an upper section 46. The lower section 44 comprises a flat and vertical side wall 48 which provides an attachment surface to which the pickets 43 may be secured. Further comprising the lower section 46 are horizontal base 50 and a vertical lip 52, with the base 50 connecting the vertical lip 52 to the lower end of side wall 48. The side wall 48, base 50 and vertical lip 52 cooperate to form an internal tray 54 which extends the length of the rail 42.

The internal tray 54 defines a longitudinal internal recess within the rail 12 which is sized to closely but clearingly accommodate at least one strengthening cable. In some embodiments, it may be desirable to size the internal recess to closely but clearingly receive two strengthening cables having the same cross-sectional dimensions, situated in side-by-side relationship. Thus, the embodiment shown in FIGS. 7 and 8, the internal tray 54 is sized to closely but clearingly receive a primary strengthening cable 56 and a secondary strengthening cable 58. Because the internal tray 54 is positioned on the back side of the fence and protected by vertical lip 52, a strengthening cable within the internal tray 54 cannot easily be accessed by a bolt cutter or similar tool.

The upper section 46 of the rail 42 preferably comprises a slanted upper front wall 60 and a slanted upper rear wall 62, which meet at their shared upper edges to define an inverted V-shaped structure. The lower edge of upper front wall 60 forms the upper edge of side wall 48. In order to deter or interfere with climbing of the fence 200, pointed spikes 64 may be formed in the upper front wall 60. Such spikes 64 may be formed by making a slit in the upper front wall 60 in the shape of an inverted V, and bending the resulting triangular tab outwardly to form a spike.

The upper section 46 of the rail 42 preferably further comprises a L-shaped upper end section 66, formed from a vertical inner wall 68 which terminates in an inwardly-projecting horizontal lip 70. The upper edge of the vertical inner wall 68 is shared with the lower edge of the upper rear wall 62. The inwardly projecting lip 70 formed in the upper section 46 increases the strength of the rail 42.

Preferably, each panel 234 comprises at least three, and more preferably four or more rails 42, disposed in parallel and spaced relationship. In an installed configuration of the panel 234, the incline of each rail 42 with respect to horizontal preferably is substantially equal to the incline of the terrain 72 if the pair of posts 202 upon which that panel 31 will be installed. Thus, when the fence 200 is positioned on horizontal terrain, as shown in FIG. 1, the rails 42 of each panel 234 will be disposed substantially horizontally.

As shown in FIGS. 2, 3 and 4, each panel 234 is preferably provided with an upper rail situated adjacent the top of the panel 234, and a lower rail, situated adjacent the base of the panel 234. At least one, and preferably two or more intermediate rails are provided between the upper and lower rails. In one preferred embodiment, well-adapted for resisting a vehicular intrusion, each panel is provided with a first intermediate rail 236 and second intermediate rail 238. The first intermediate rail 236 preferably situated between about 30 inches and about 38 inches above the base of the panel, while the second intermediate rail 238 is preferably situated between about 44 inches and about 52 inches above the base of the panel. A particularly preferred panel comprises a first intermediate rail 236 situated about 34 inches above the base of the panel and a second intermediate rail 238 situated about 48 inches above the base of the panel.

With reference to FIGS. 2, 3 and 4, the pickets 43 which comprise each panel 234 are preferably of identical size and construction, and are formed from a strong and durable material, such as a strip of sheet steel. In a preferred embodiment of the present invention, the steel is characterized by a thickness of 0.075 inches. In order to enhance its resistance to corrosion, this steel is preferably subjected to a pre-galvanizing treatment. The pre-galvanized steel is then subjected to a cold rolling process to produce a final configuration, which may feature a corrugated or W-shaped profile. After cold rolling is complete, a polyester powder coating is preferably provided in order to further enhance corrosion resistance of the picket 43. Further details about the construction of the pickets 43 is provided in copending U.S. patent application Ser. No. 10/306,125, filed Nov. 27, 2002, the entire disclosure of which is incorporated by reference.

The panel 234 is preferably assembled by aligning a plurality of rails 42 in the spaced and parallel relationship required by the panel design. While the rails 42 are maintained in this aligned position, a picket 43 is extended in transverse relationship to the rails 42. A plurality of fasteners 80, such bolts or screws, is used to attach the picket 43 to each of the rails 42 which it traverses. Preferably the picket 43 is attached to each rail 43 at its respective side wall 48. Additional pickets 43 are attached to the aligned rails 42 in like manner, until a fully assembled panel 234 results.

The length of each picket 43, which corresponds to the vertical height of the picket 43 once the panel 43 is installed, preferably equals or exceeds the vertical above-ground height of the posts 202 in an installed configuration. A picket length of between about 6 feet and about 10 feet is preferred. The pickets 43 are preferably oriented in parallel relationship, with a separation distance between adjacent pickets 43 which is sufficiently small to prevent an intruder from traversing the gap. In one preferred embodiment, the separation distance between the centers of adjacent pickets 43, is between about 5 inches and about 7 inches.

The number of pickets 43 in the panel 234 should be sufficient to assure that the separation distance between adjacent pickets 43, or between a post 202 and an adjacent picket 43, does not exceed the requisite preventative distance. In the embodiment shown in FIGS. 1-3, each panel 234 is formed from 15 pickets.

The upper end 82 of each picket 43 may be formed into a pointed or sharpened configuration which will deter and hinder climbing, such as a spear or spike. In the embodiment shown in FIGS. 2, 3 and 4, the upper end 82 of each picket 43 has been formed in a splayed configuration providing a plurality of spear-like protrusions. Alternately, pickets having round or flat tops may be used.

As best shown in FIGS. 9 and 12, a plurality of apertures 84 are formed in the web section 24 of each upright post 208, preferably by stamping. Preferably, the apertures 84 are placed in the steel sheet used to form the upright post 208 before the sheet undergoes cold rolling. The number of apertures 84 formed in the web section 24 should be greater than or equal to the number of rails 42 comprising a panel 234.

As best shown in FIG. 12, the apertures 84 should be positioned so that, in an installed configuration of the upright post 208, each of the rails 42 in a panel 234 may be aligned with a respective aperture 18 in the upright post 208. If desired, apertures may provided in a number and with a spacing which will accommodate more than one panel configuration, such as both a three-rail and a four-rail panel. Thus, in the post shown in FIG. 12, the aperture 85 is adapted for use with a three-rail panel, and is not used in a fence formed from the four-rail panels shown in FIGS. 1-3.

Figure 10:
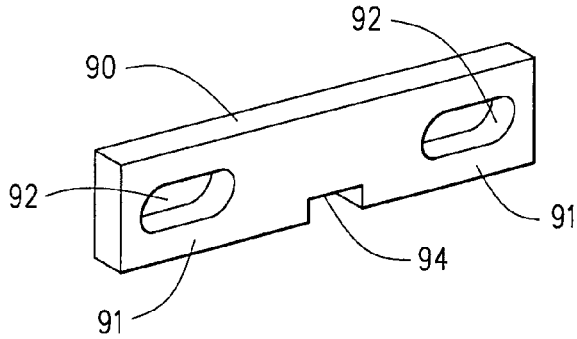
FIG. 10 is a perspective view of the fish plate of the present invention.
Figure 11:
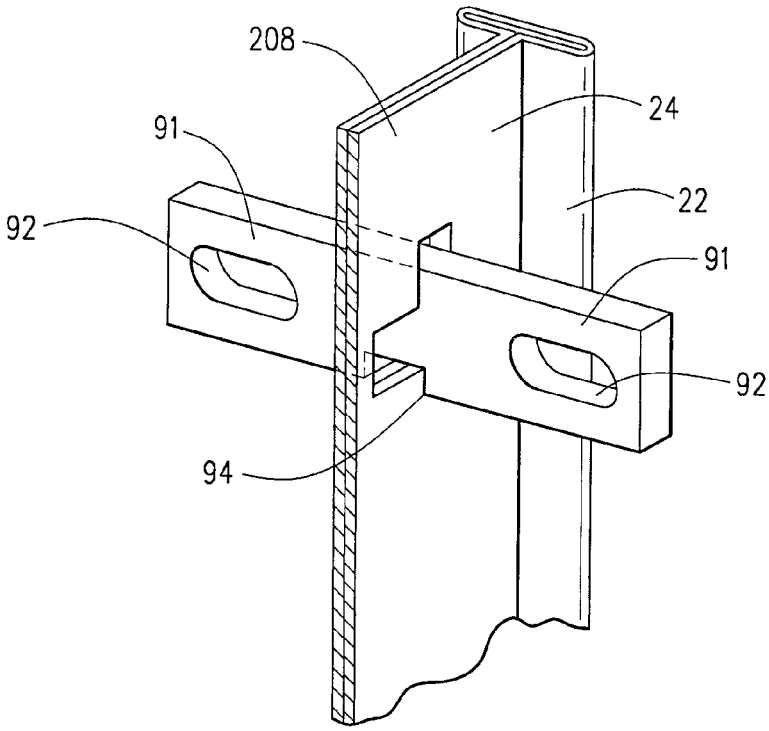
FIG. 11 is a perspective view fish plate and a portion of the upright post of the present invention, in their assembled configuration. One of the flanges has been remove in order to permit better display of other components.
Figure 13:
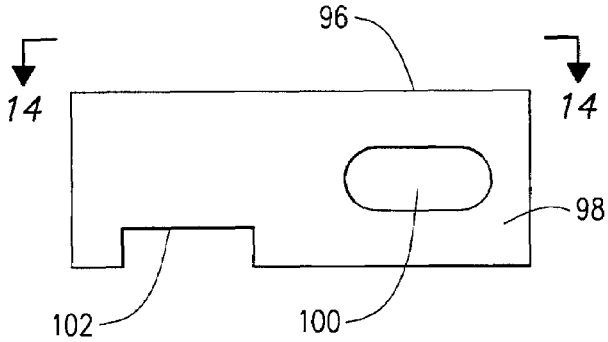
FIG. 13 is a front elevational view of an end bracket.
Figure 14:
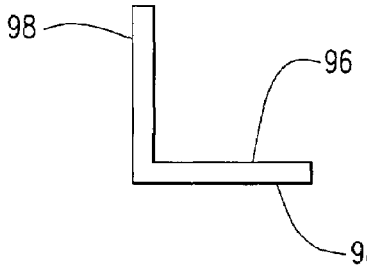
FIG. 14 is a top plan view of the end bracket shown in FIG. 13, taken along line 14-14.

Each of the apertures 84 is sized to receive, with minimal cross-sectional clearance, a connector, which may be either an elongate fish plate 90, shown in FIGS. 10 and 11, or an end bracket 96, shown in FIGS. 13 and 14. Each aperture 84 is preferably characterized by an "L" shape which includes a first arm 86, which extends parallel to the longitudinal axis of the post 202, and a second arm 88, which extends transversely to the first arm 86. The first arm 86 is preferably sized to receive the connector with minimal cross-sectional clearance.

The fish plate 90 is an elongate structure, preferably planar, and is characterized by a opposed pair of wings 91, each of which is penetrated by an elongate fastener opening 92. Intermediate the wings 91, a lock notch 94 is formed in the base of the fish plate 90. As shown in FIGS. 4 and 11, the fish plate 90 is inserted into the first arm 86 of the aperture 84 so that the lock notch 94 is aligned with the web 24. Lateral movement of the installed fish plate 90 is possible, but is limited by the lock notch 94. The fish plate 90 is preferably formed from a strong and durable material, such as steel.

The end bracket 96, shown in FIGS. 13 and 14, is similar in construction to the fish plate 90, and is characterized by a pair of wings 98, which are oriented in perpendicular relationship. One of the wings 98 includes a fastener opening 100, while the other wing need not include such an opening. Much as with the fish plate 100, the end bracket 96 includes a lock notch 102 situated between the wing. The end bracket 96 is installed by inserting the wing 98 having the fastener opening 100 into the slot 76 of a post 202, so that the lock notch 92 is aligned with the web 40. In this installed configuration, one of the wings 98 abuts against the web 40 of the post 202, while the wing having the fastener opening 100 projects from the post 202.

The second arm 88 of each aperture 84 will remain clear and unobstructed even after installation of the connector into the aperture 84. The second arm 88 of each aperture 84 preferably functions as a cable passageway 89, and is characterized by dimensions which are sufficient to permit clearing passage of two strengthening cables, such as primary and secondary strengthening cables 56 and 58. The construction and arrangement of the strengthening cable of the present invention will be described in greater detail hereafter.

In an alternate embodiment, not shown in the Figures, each aperture 84 may be replaced by a pair of adjacent passageways through the post 202. One of these passageways comprises a cable passageway, preferably square or circular in shape, and is characterized by dimensions which are sufficient to permit clearing passage of two strengthening cables, such as primary and secondary strengthening cables 56 and 58. The other such passageway is a slot extending parallel to the longitudinal axis of the rail 42, which is sized to clearingly receive the connector. These passageways are formed in the web section 24 of the post 202, preferably by stamping, and are preferably placed in the steel sheet used to form the post 202 before the sheet undergoes cold rolling.

A panel 234 is installed on an upright posts 208, or between an adjacent pair of upright posts 208, by inserting connectors, comprising either a fish plate 90 or an end bracket 96, in the apertures of the upright post 208. A connector should be installed in each aperture of an upright post 208 which registers with a rail of panel 234. When an upright post 208 supports more than one panel 234, as will typically be the case, a fish plate 90 preferably comprises the connector.

In order to connect a rail 42 of a panel 234 to a fish plate 90, the rail 42 is positioned so that the inner side of its vertical side wall 48 engages one of the wings 91 of the fish plate 90. The fastener opening 92 in the fish plate 90 is aligned with a corresponding opening (not shown) formed in the vertical side wall 48. A fastener (not shown) is inserted through the pair of aligned openings and secured in place by a holder, such as a nut or collar. The rail 42 of an adjacent panel 234 is similarly connected to the other wing 91 of the fish plate 90. Each fish plate 90 thereby functions to maintain laterally adjacent rails 42 in end-to-end alignment.

When the rails 42 of adjacent panels 234 of the fence 200 extend in collinear relationship, the fish plate 90 to which those panels 234 are connected should be a planar structure. When rails of adjacent panels 234 define an included angle other than 180 degrees, the fish plate 90 should be configured so that its wings 92 define the same included angle as the adjacent rails to which it will be attached. When the fence 200 includes any such angled panels 234, the supporting post 12 for those panels 234 is preferably oriented so that its web section 24 bisects the included angle defined by the adjoining panels 234.

As shown in FIG. 17, one or more connector apertures are formed in each side of the bollard post 204 in which a cable slot is also formed. The apertures should be longitudinally positioned so as to register with the rails of panel 234 in which a cable assembly will not be installed. Thus, in the embodiment shown in FIG. 17, a first connector aperture 242 and a spaced second connector aperture 242 are formed in two opposed sides of the bollard post. The first connector aperture 242 is positioned to register with the upper rail of panel 234, while the second aperture 244 is positioned to register with the lower rail of panel 234. The connector apertures are preferably rectangular in shape, and are sized to closely but clearly receive a connector, which preferably comprises an end bracket 96.

A panel 234 is installed on a bollard post 204 by inserting a connector, preferably comprising an end bracket 96, into each of the connector apertures formed in the bollard post 204. A portion of the connector is thereby positioned within the bollard post 204, while another portion of the connector, projects out of the bollard post 204 through the connector aperture. When the connector comprises end bracket 96, its projecting wing 98 is secured by a fastener to the single rail which it supports, in a manner substantially identical to that described with reference to the fish plate 90.

Figure 20:
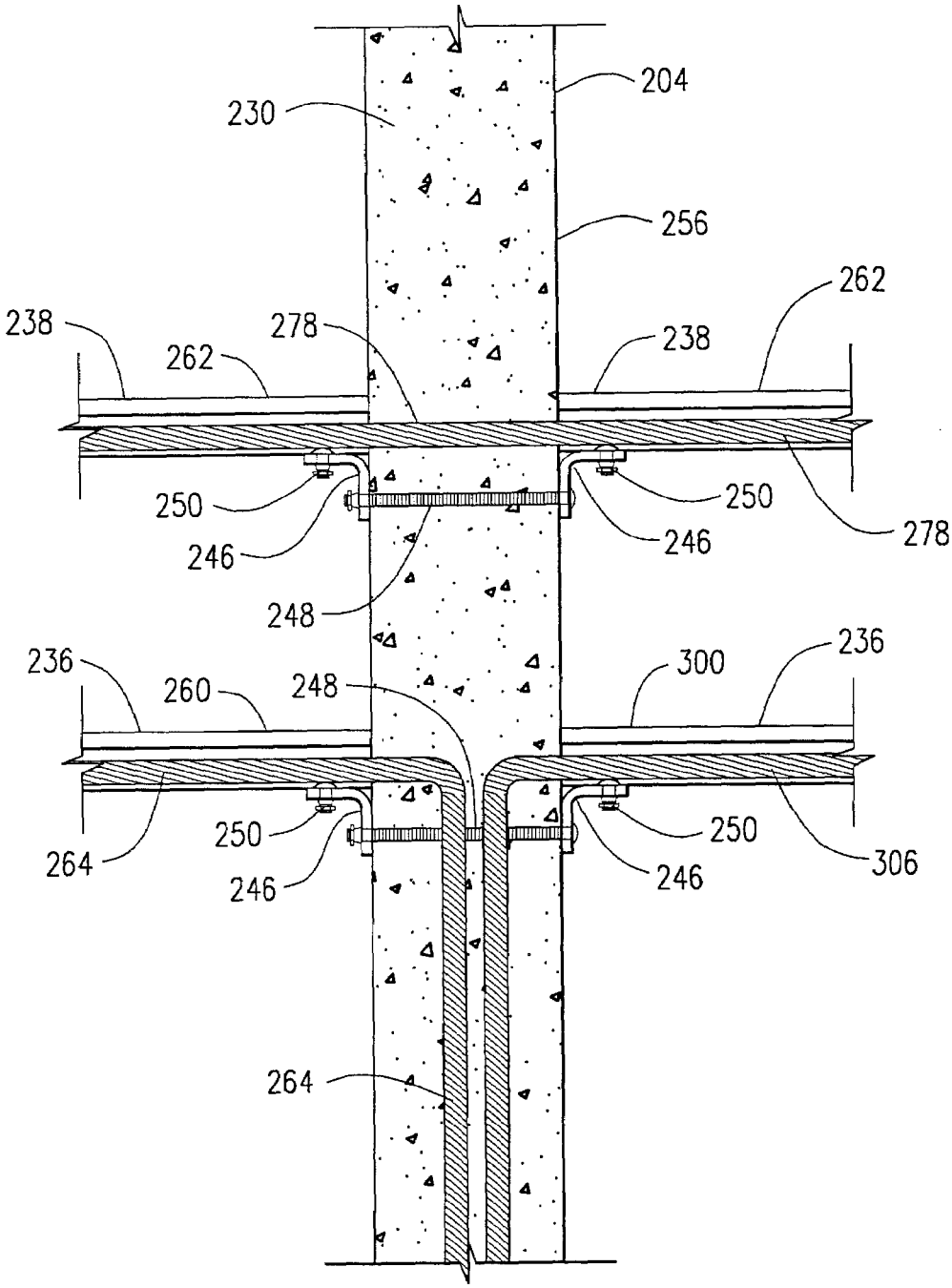
FIG. 20 is an enlarged and detailed cross-sectional view of the second bollard post and its associated rail systems and rail cable assemblies.
Figure 21:
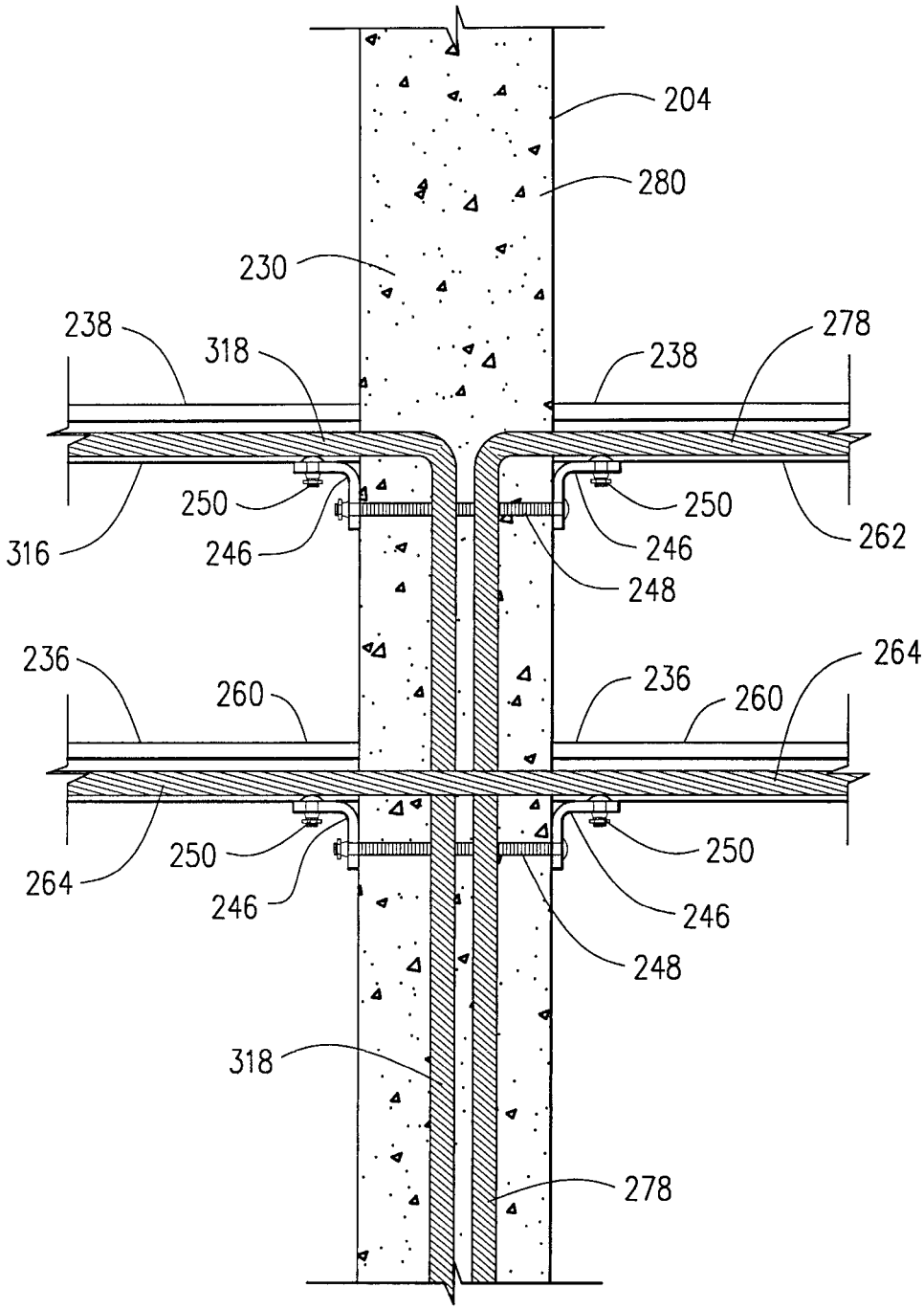
FIG. 21 is an enlarged and detailed cross-sectional view of the third bollard post and its associated rail systems and rail cable assemblies.

As shown in FIGS. 20 and 21, those rails of the panel 234 in which cable assemblies are installed are preferably not secured to the bollard post 204 by the same kind of internal connection used with the non-cable rails. Instead, a L-shaped rail support bracket 246, preferably having substantially the same size and configuration as end bracket 96, is externally mounted on the bollard post 204, beneath each of the cable slots. Preferably, rail support brackets 246 situated on opposing sides of the bollard post are aligned and connected to the bollard post 204 by a common connector 248, such as a bolt, which extends through the bollard post 204. The underside of each cable-carrying rail of the panel 246, such as the first and second intermediate rails 236 and 238 shown in the Figures, is secured to a corresponding rail support bracket 246 by a connector 250, such as a carriage bolt.

Figure 23:
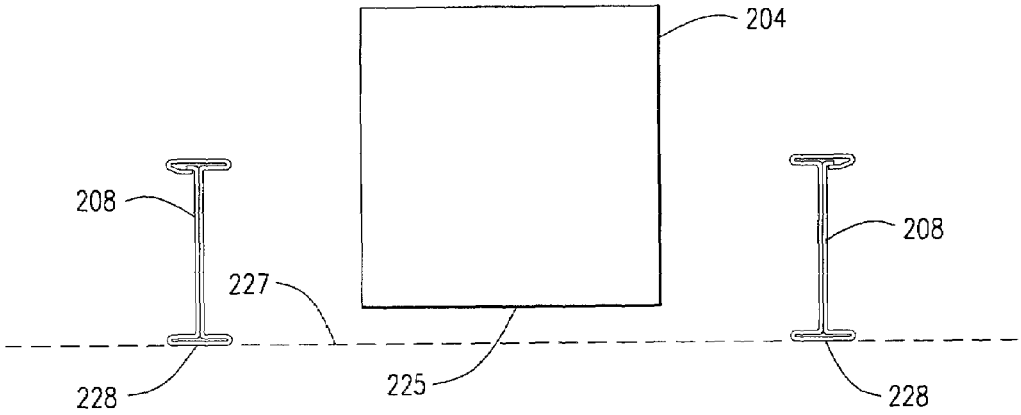
FIG. 23 is a semi-schematic plan view illustrating the positioning of a bollard post in relationship to its adjacent intermediate posts.

Preferably, the picket 224 which is supported by the bollard post 204 is aligned with the pickets of the of the panel or panels 234 which the bollard post 204 supports. In order to establish such alignment, each bollard post 204 is preferably set back from the plane 227 defined by the flange section 228 of the immediately adjoining upright post 208, as shown in FIG. 23. In the embodiment shown in the Figures, side 225 of the bollard post 224 is set back ¾ inches from plane 228.

Panels 234 are supported by each adjacent pair of posts 202 comprising the first plurality. As shown in FIGS. 1-3, when the fence 200 is assembled, each rail in a given panel 234 is aligned at one or both of its ends with a rail of an adjacent panel. Each set of aligned rails which extends along a substantially continuous line or curve between the first bollard post 252 and the second bollard post 256 comprises a rail system, and forms a barrier which traverses the interval between these posts.

The fence 200 further comprises a first rail system 260 supported by the first plurality of posts so as to form a barrier between each adjacent pair of the first plurality of posts. The first rail system 260 is characterized by a first end 288 and a second end 290. In the embodiment of FIGS. 1-3, the first rail system 262 is preferably formed from the plurality of panels 234 which are installed between adjacent posts of the first plurality. The first intermediate rails 236 of this set of installed panels 234 preferably form the first rail system 262. These first intermediate rails 236 are disposed in end-to-end relationship so as to extend along a line or curve, thereby traversing the interval between the first and second bollard posts 252 and 256.

The aligned internal trays of the rails comprising the first rail system 260 cooperate to define a longitudinal internal recess within that rail system. Although this internal recess is periodically interrupted by the intermediate posts of the first plurality, registering first cable passageways are formed in these intermediate posts. These cable passageways allow a cable to extend along a substantially continuous, straight-line path within the internal recess of the rail system.

As shown in FIGS. 16-19, the fence 200 further comprises a first rail cable assembly comprising a first cable 264 having a first end 266, shown in FIG. 18, an opposed second end 268, shown in FIG. 19, and a medial portion intermediate the first and second ends. The first cable 264 preferably comprises a length of steel wire rope having a diameter of 1 inch, and should be galvanized. More preferably, the wire rope is characterized by six multiwired strands laid around an independent wire rope core. A particularly preferred wire rope configuration is 6×36 Warrington Seale with independent wire rope core.

The medial portion of the first cable 264 extends within the internal recess of at least a portion of the first rail system 260, and preferably within the entirety of the first rail system 260. Preferably, the first cable 264 extends through the first cable passageways of each of the intermediate posts, as well as through the cable openings in the first and second bollard posts 252 and 256 which register with the first rail system 260.

The first rail cable assembly further comprises a first anchor substrate, which is preferably situated adjacent the first end 288 of the first rail system 260, and is preferably at least partially underground. The first anchor substrate, which anchors the first cable 264 adjacent its first end 266, comprises the ballast 230 within the first bollard post 252, in combination with the first bollard post 252, which anchors and restrains the ballast 230, and the first bollard substrate 254, which in turn anchors and restrains the first bollard post 252. As shown in FIG. 18, the first cable 264 is preferably embedded within the ballast 230 which fills the first bollard post 252, with the first end 266 situated below ground level and immediately adjacent the base of the first bollard post 252.

The first rail cable assembly further comprises a second anchor substrate, which is preferably situated adjacent the second end 290 of the first rail system 260, and is preferably at least partially underground. The second anchor substrate, which anchors the first cable 264 adjacent its second end 268, comprises the ballast 230 within the second bollard post 256, in combination with the second bollard post 256, which anchors and restrains the ballast 230, and the second bollard substrate 258, which in turn anchors and restrains the second bollard post 256. As shown in FIG. 19, the first cable 264 is preferably embedded within the ballast 230 which fills the first bollard post 252, with the first end 268 situated below ground level and immediately adjacent the base of the second bollard post 256.

The first cable 264 should have a length sufficient to extend within the first rail system 260 and span the distance between the first and second anchor substrates as described above. In one preferred embodiment, the length of the first cable 264 is at least about 80 feet, and preferably between about 80 feet and about 85 feet.

Figure 22:
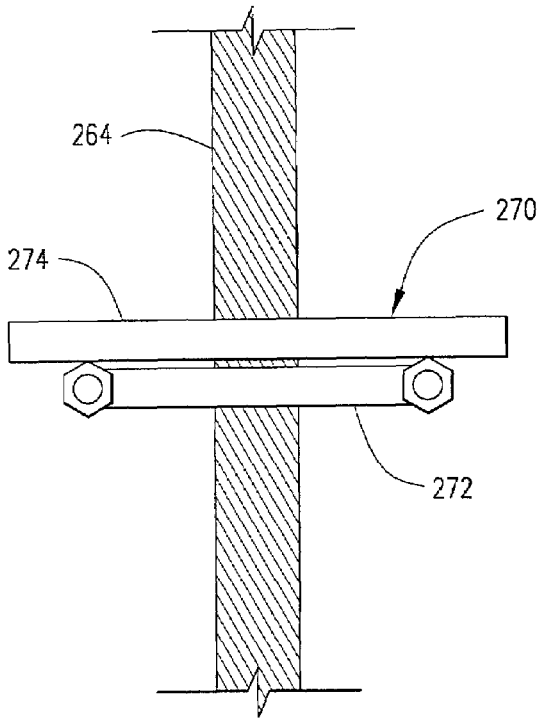
FIG. 22 is an enlarged and detailed view of the anchor plates of one of the anchors of a rail cable assembly.

As shown in FIGS. 18, 19 and 22, the first rail cable assembly preferably further comprises at least one, and preferably a plurality of first anchors 270, which anchor the first cable 264 adjacent its first end 266. Each of the first anchors 270 is at least partially, and preferably completely, embedded in the first anchor substrate. More preferably, each of the first anchors 270 is embedded in the ballast 230 of the first bollard post 252, most preferably at a position below ground level. In a preferred embodiment, the first rail cable assembly comprises four first anchors 270, installed at vertically spaced locations adjacent the first end 266 of the first cable 264.

Each first anchor 270 should be characterized by a cross-sectional profile having dimensions which substantially exceed the cross-sectional dimensions of the first cable 264. The cross-sectional profile of the anchor creates frictional and steric resistance to pullout of the first cable 264 from the first anchor substrate.

As best shown in FIG. 22, each first anchor 270 preferably comprises a U-shaped cable clamp 272 which is secured around the first cable 264. The first anchor 264 further comprises a flat anchor plate 274 which rests atop the cable clamp 272. In one preferred embodiment, the anchor plate 274 comprises a square or circular steel plate having a side or diameter of between about 3 inches and about 3½ inches, and a thickness of 0.25 inches. The anchor plate 274 is preferably provided with a centrally disposed circular opening (not shown) through which the first cable 264 may be clearingly received. When the first cable 264 has a diameter of 1 inch, a preferred diameter for the opening in the anchor plate is 1.25 inches.

As illustrated in FIG. 19, the first rail cable assembly further comprises at least one, and preferably a plurality of second anchors 276, which anchor the first cable 264 adjacent its second end 268. Each of the second anchors 276 is preferably identical in size, construction and configuration to the first anchor 270, and is at least partially, and preferably completely, embedded in the first anchor substrate. More preferably, each of the second anchors 276 is embedded in the ballast 230 of the second bollard post 256, most preferably at a position below ground level. The number, positioning, installation and attachment of the second anchors 276 on the first cable 264 is preferably identical to that preciously described with reference to the first anchors 270 and the first cable 264.

In the embodiment shown in FIGS. 1, 3, 19 and 21, a second plurality of posts forming the fence 200 comprises a third bollard post 280 and a spaced fourth bollard post 284, which serve as terminal posts. The second plurality of posts further comprises at least one, and preferably a plurality of intermediate posts situated between the terminal posts. The number of posts in the second plurality preferably equals the number in the first plurality.

The third bollard post 280 is supported by a third bollard substrate 282, while the fourth bollard post 284 is supported by a fourth bollard substrate 286. The third and fourth bollard posts 280 and 284 are preferably identical in construction and configuration to the first bollard post 252, while the third and fourth bollard substrates 282 and 286 are likewise preferably identical in construction and configuration to the first bollard substrate 254. The intermediate posts comprising the second plurality preferably have the same constructions and configurations as described with reference to the intermediate posts comprising the first plurality. Each of the intermediate posts is supported by an intermediate post substrate, having the same size and configuration as the intermediate post substrates described with reference to the first plurality of posts 202.

The fence 200 further comprises a second rail system 262 supported by the second plurality of posts so as to form a barrier between each adjacent pair of the second plurality of posts. The second rail system 262 is preferably vertically spaced from the first rail system 260 and is characterized by a first end 292 and a second end 294.

In the embodiment shown in FIGS. 1-3, the second rail system 262 is formed from a plurality of panels 234, preferably of identical size and construction to those described with reference to the first plurality of posts. The panels 234 are supported from each adjacent pair of posts comprising the second plurality, preferably in the same manner described with reference to the first plurality. The second intermediate rails 238 of this set of installed panels 234 preferably form the second rail system 262. These second intermediate rails 238 are disposed in end-to-end relationship so as to extend along a line or curve, thereby traversing the interval between the third and fourth bollard posts 280 and 284.

The aligned internal trays of the rails comprising the second rail system 262 cooperate to define a longitudinal internal recess within that rail system. Although this internal recess is periodically interrupted by the intermediate posts of the second plurality, registering second cable passageways are formed in these intermediate posts. These cable passageways allow a cable to extend along a substantially continuous, straight-line path within the internal recess of the rail system.

The fence 200 further comprises a second rail cable assembly comprising a second cable 278 having a first end (not shown), an opposed second end (not shown), and a medial portion between the first and second ends. The second cable 278 is preferably characterized the same construction as the first cable 264.

The medial portion of the second cable extends within the internal recess of at least a portion of the second rail system 262, and preferably within the entirety of the second rail system 262. Preferably, the second cable 278 extends through the second cable passageways of each of the intermediate posts, as well as through the cable openings in the third and fourth bollard posts 280 and 284 which register with the second rail system 262.

The second rail cable assembly further comprises a third anchor substrate, which is preferably situated adjacent the first end 292 of the second rail system 262, and is preferably at least partially underground. The third anchor substrate, which anchors the second cable 278 adjacent its first end, comprises the ballast 230 within the third bollard post 280, in combination with the third bollard post 280, which anchors and restrains the ballast 230, and the third bollard substrate 282, which in turn anchors and restrains the third bollard post 280. The second cable 278 is preferably positioned within the third anchor substrate in the same configuration described with reference to the first cable 264 and the first anchor substrate.

The second rail cable assembly further comprises a fourth anchor substrate, which is preferably situated adjacent the second end 294 of the second rail system 262, and is preferably at least partially underground. The fourth anchor substrate, which anchors the second cable 278 adjacent its second end, comprises the ballast 230 within the fourth bollard post 284, in combination with the fourth bollard post 284, which anchors and restrains the ballast 230, and the fourth bollard substrate 286, which in turn anchors and restrains the second bollard post 256. The second cable 278 is preferably positioned within the fourth anchor substrate in the same configuration described with reference to the first cable 264 and the first anchor substrate.

The second cable 278 should have a length sufficient to extend within the second rail system 262 and span the distance between the third and fourth anchor substrates as described above. Because the second rail system 262 is situated farther from the terrain 205 than the first rail system 260 in the embodiment shown in FIGS. 1-3, the second cable 278 should be somewhat longer than the first cable 264 in that embodiment.

The second rail cable assembly preferably further comprises at least one, and preferably a plurality of third anchors (not shown) which anchor the second cable 278 adjacent its first end. Each of the third anchors is preferably identical in size, construction and configuration to the first anchor 270, and is at least partially, and preferably completely, embedded in the third anchor substrate. More preferably, each of the third anchors is embedded in the ballast 230 of the third bollard post 280, most preferably at a position below ground level. The number, positioning, installation and attachment of the third anchors on the second cable 278 is preferably identical to that described with reference to the first anchors 270 and first cable 264.

The second rail cable assembly preferably further comprises at least one, and preferably a plurality of fourth anchors (not shown) which anchor the second cable 278 adjacent its second end. Each of the fourth anchors is preferably identical in size, construction and configuration to the first anchor 270, and is at least partially, and preferably completely, embedded in the fourth anchor substrate. More preferably, each of the fourth anchors is embedded in the ballast 230 of the fourth bollard post 284, most preferably at a position below ground level. The number, positioning, installation and attachment of the fourth anchors on the second cable 278 is preferably identical to that described with reference to the first anchors 270 and first cable 264.

In the embodiment shown in FIGS. 1-3, the first and second pluralities are characterized by equal numbers of posts 202, namely 9, with 5 posts belonging to both pluralities. This configuration results in a horizontal offset of the second rail system 262 in relationship to the first rail system 260, such that the midpoint of the first rail system 260 is vertically aligned with an endpoint of the second rail system 262. If such a horizontally offset configuration is desired, it is preferred that the shared membership of the pluralities of posts supporting the two overlapping rail systems equal between about 40% and about 60% of the membership of one such plurality. Such an overlapping configuration assures that the fence has no uncabled gaps, and also permits dispersal the anchors for the cables. Thus, the first cable 264 is anchored by different pair of anchor substrates than the second cable 278 at any given point along the fence perimeter. Such dispersal can reduce the vulnerability of the fence to localized penetration or attack.

In other embodiments (not shown), the first and second pluralities of posts 202 may be identical, which will result in vertical alignment of the first and second rail systems 260 and 262 at both of their respective endpoints. In such an embodiment, the first anchor substrate preferably also serves as the third anchor substrate, and the second anchor substrate preferably also serves as the fourth anchor substrate. In yet other embodiments, the first and second pluralities of posts may comprise unequal numbers of posts.

A third plurality of posts forming the fence 200 preferably comprises a fifth bollard post and a spaced sixth bollard post 296, which serve as terminal posts. In the embodiment shown in FIGS. 1 and 3, the second bollard post 256 preferably serves as the fifth bollard post. The third plurality of posts further comprises at least one, and preferably a plurality of intermediate posts situated between terminal posts. The number of posts in the third plurality preferably equals the number in the first plurality.

The fifth bollard post is supported by a fifth bollard substrate, which preferably comprises the second bollard substrate 258. The sixth bollard post 296 is supported by a sixth bollard substrate 298. The bollard posts comprising the third plurality are preferably identical in construction and configuration to the first bollard post 252, while the bollard substrates supporting these bollard posts are likewise preferably identical in construction and configuration to the first bollard substrate 254. The intermediate posts comprising the third plurality preferably have the same constructions and configurations as described with reference to the intermediate posts comprising the first plurality. Each of the intermediate posts is supported by an intermediate post substrate, having the same size and configuration as the intermediate post substrates described with reference to the first plurality of posts 202.

The fence 200 further comprises a third rail system 300 supported by the third plurality of posts so as to form a barrier between each adjacent pair of the third plurality of posts. The third rail system 300 is preferably aligned the first rail system 260 and is characterized by a first end 302 and a second end 304.

In the embodiment shown in FIGS. 1-3, the third rail system 300 is formed from a plurality of panels 234, preferably of identical size and construction to those described with reference to the first plurality of posts. The panels 234 are supported from each adjacent pair of posts comprising the third plurality, preferably in the same manner as described with reference to the first plurality. The first intermediate rails 236 of this set of installed panels 234 preferably form the third rail system 300. These first intermediate rails 236 are disposed in end-to-end relationship so as to extend along a line or curve, thereby traversing the interval between the fifth and sixth bollard posts.

The aligned internal trays of the rails comprising the third rail system 300 cooperate to define a longitudinal internal recess within that rail system. Although this internal recess is periodically interrupted by the intermediate posts of the third plurality, registering first cable passageways are formed in these intermediate posts. These cable passageways allow a cable to extend along a substantially continuous, straight-line path within the internal recess of the rail system.

The fence 200 further comprises a third rail cable assembly comprising a third cable 206 having a first end 308, an opposed second end (not shown), and a medial portion between the first and second ends. The third cable 306 is preferably characterized the same construction as the first cable 264.

The medial portion of the third cable 306 extends within the internal recess of at least a portion of the third rail system 300, and preferably within the entirety of the third rail system 300. Preferably, the third cable 306 extends through the first cable passageways of each of the intermediate posts, as well as through the cable openings in the fifth and sixth bollard posts which register with the third rail system 300.

The third rail cable assembly further comprises a fifth anchor substrate, which is preferably situated adjacent the first end 302 of the third rail system 300, and is preferably at least partially underground. The fifth anchor substrate, which anchors the third cable 306 adjacent its first end, preferably comprises the ballast 230 within the fifth bollard post, in combination with the fifth bollard post, which anchors and restrains the ballast 230, and the fifth bollard substrate which in turn anchors and restrains the fifth bollard post. The third cable 306 is preferably positioned within the fifth anchor substrate in the same configuration described with reference to the first cable 264 and the first anchor substrate.

The third rail cable assembly further comprises a sixth anchor substrate, which is preferably situated adjacent the second end 304 of the third rail system 300, and is preferably at least partially underground. The sixth anchor substrate, which anchors the third cable 306 adjacent its second end, comprises the ballast 230 within the sixth bollard post 296, in combination with the sixth bollard post 296, which anchors and restrains the ballast 230, and the sixth bollard substrate 298, which in turn anchors and restrains the sixth bollard post 296. The third cable 306 is preferably positioned within the sixth anchor substrate in the same configuration described with reference to the first cable 264 and the first anchor substrate.

The third cable 306 should have a length sufficient to extend within the third rail system 300 and span the distance between the fifth and sixth anchor substrates as described above.

The third rail cable assembly preferably further comprises at least one, and preferably a plurality of fifth anchors (not shown) which anchor the third cable 306 adjacent its first end 308. Each of the fifth anchors is preferably identical in size, construction and configuration to the first anchor 270, and is at least partially, and preferably completely, embedded in the fifth anchor substrate. More preferably, each of the fifth anchors is embedded in the ballast 230 of fifth bollard post, most preferably at a position below ground level. The number, positioning, installation and attachment of the fifth anchors on the third cable 306 is preferably identical to that described with reference to the first anchors 270 and first cable 264.

The third rail cable assembly preferably further comprises at least one, and preferably a plurality of sixth anchors (not shown) which anchor the third cable 306 adjacent its second end. Each of the sixth anchors is preferably identical in size, construction and configuration to the first anchor 270, and is at least partially, and preferably completely, embedded in the sixth anchor substrate. More preferably, each of the sixth anchors is embedded in the ballast 230 of the sixth bollard post 296, most preferably at a position below ground level. The number, positioning, installation and attachment of the sixth anchors on the third cable 306 is preferably identical to that described with reference to the first anchors 270 and first cable 264.

As shown in FIG. 3, the third rail system 300 is aligned with the first rail system 260. Such alignment is a consequence of the use of identical panels 234 to form the first and third rail systems 260 and 300. In the embodiment shown in FIGS. 1-3, the shared membership of the first and third pluralities is limited to a post: the bollard post 256, which serves as the second bollard post in the first plurality and as the fifth bollard post in the third plurality. This configuration places the first and third rail systems 260 and 300 in immediately adjacent end-to-end relationship.

In other embodiments of the invention, not shown in the Figures, the first and third pluralities of posts may have an overlapping membership of two or more posts. Such a configuration will cause the first and third rail systems to partially coincide, with one or more rails serving in both systems. In such an embodiment, the first cable passageways should be enlarged, or an additional cable passageway formed, in order to permit passage of two cables through the intermediate posts which support both rail systems. In yet other embodiments, there may be no overlap in membership between the first and third pluralities of posts.

A fourth plurality of posts forming the fence 200 preferably comprises a seventh bollard post and a spaced eighth bollard post 310, which serve as terminal posts. In the embodiment shown in FIG. 3, the fourth bollard post 284 preferably serves as the seventh bollard post. The fourth plurality of posts further comprises at least one, and preferably a plurality of intermediate posts situated between terminal posts. The number of posts in the fourth plurality preferably equals the number in the first plurality.

The seventh bollard post is supported by a seventh bollard substrate, which preferably comprises the fourth bollard substrate 286. The eighth bollard post 310 is supported by an eighth bollard substrate 312. The bollard posts comprising the fourth plurality are preferably identical in construction and configuration to the first bollard post 252, while the bollard substrates supporting these bollard posts are likewise preferably identical in construction and configuration to the first bollard substrate 254. The intermediate posts comprising the fourth plurality preferably have the same constructions and configurations as described with reference to the intermediate posts comprising the first plurality. Each of the intermediate posts is supported by an intermediate post substrate, having the same size and configuration as the intermediate post substrates described with reference to the first plurality of posts 202.

The fence 200 further comprises a fourth rail system 314 supported by the fourth plurality of posts so as to form a barrier between each adjacent pair of the fourth plurality of posts. The fourth rail system 314 is preferably vertically spaced from the third rail system 300 and is characterized by a first end, situated adjacent the seventh bollard post, and a second end, situated adjacent the eighth bollard post 310. The fourth rail system 314 is preferably aligned the second rail system 262.

In the embodiment shown in FIG. 1, the fourth rail system 314 is formed from a plurality of panels 234, preferably of identical size and construction to those described with reference to the first plurality of posts. The panels 234 are supported from each adjacent pair of posts comprising the fourth plurality, preferably in the same manner as described with reference to the first plurality. The second intermediate rails 238 of this set of installed panels 234 preferably form the fourth rail system 314. These second intermediate rails 238 are disposed in end-to-end relationship so as to extend along a line or curve, thereby traversing the interval between the seventh and eighth bollard posts.

The aligned internal trays of the rails comprising the fourth rail system 314 cooperate to define a longitudinal internal recess within that rail system. Although this internal recess is periodically interrupted by the intermediate posts of the fourth plurality, registering second cable passageways are formed in these intermediate posts. These cable passageways allow a cable to extend along a substantially continuous, straight-line path within the internal recess of the rail system.

The fence 200 further comprises a fourth rail cable assembly comprising a fourth cable (not shown) having a first end (not shown), an opposed second end (not shown), and a medial portion between the first and second ends. The fourth cable is preferably characterized the same construction as the first cable 264.

The medial portion of the fourth cable extends within the internal recess of at least a portion of the fourth rail system 314, and preferably within the entirety of the fourth rail system 314. Preferably, the fourth cable extends through the second cable passageways of each of the intermediate posts, as well as through the cable openings in the seventh and eighth bollard posts which register with the fourth rail system 314.

The fourth rail cable assembly further comprises a seventh anchor substrate, which is preferably situated adjacent the first end of the fourth rail system 314, and is preferably at least partially underground. The seventh anchor substrate, which anchors the fourth cable adjacent its first end, preferably comprises the ballast 230 within the seventh bollard post, in combination with the seventh bollard post, which anchors and restrains the ballast 230, and the seventh bollard substrate which in turn anchors and restrains the seventh bollard post. The fourth cable is preferably positioned within the seventh anchor substrate in the same configuration described with reference to the first cable 264 and the first anchor substrate.

The fourth rail cable assembly further comprises a eighth anchor substrate, which is preferably situated adjacent the second end of the fourth rail system 314, and is preferably at least partially underground. The eighth anchor substrate, which anchors the fourth cable adjacent its second end, comprises the ballast 230 within the eighth bollard post 310, in combination with the eighth bollard post 310, which anchors and restrains the ballast 230, and the eighth bollard substrate 312, which in turn anchors and restrains the eighth bollard post 310. The fourth cable is preferably positioned within the eighth anchor substrate in the same configuration described with reference to the first cable 264 and the first anchor substrate.

The fourth cable should have a length sufficient to extend within the fourth rail system 314 and span the distance between the seventh and eighth anchor substrates as described above. Because the fourth rail system 314 is situated farther from the terrain 205 than the third rail system 300 in the embodiment shown in FIGS. 1-3, the fourth cable should be somewhat longer than the third cable 306 in that embodiment.

The fourth rail cable assembly preferably further comprises at least one, and preferably a plurality of seventh anchors (not shown) which anchor the fourth cable adjacent its first end 308. Each of the seventh anchors is preferably identical in size, construction and configuration to the first anchor 270, and is at least partially, and preferably completely, embedded in the seventh anchor substrate. More preferably, each of the seventh anchors is embedded in the ballast 230 of seventh bollard post, most preferably at a position below ground level. The number, positioning, installation and attachment of the seventh anchors on the fourth cable is preferably identical to that described with reference to the first anchors 270 and first cable 264.

The fourth rail cable assembly preferably further comprises at least one, and preferably a plurality of eighth anchors (not shown) which anchor the fourth cable adjacent its second end. Each of the eighth anchors is preferably identical in size, construction and configuration to the first anchor 270, and is at least partially, and preferably completely, embedded in the eighth anchor substrate. More preferably, each of the eighth anchors is embedded in the ballast 230 of the eighth bollard post 296, most preferably at a position below ground level. The number, positioning, installation and attachment of the eighth anchors on the fourth cable is preferably identical to that described with reference to the first anchors 270 and first cable 264.

As shown in FIG. 3, the fourth rail system 314 is aligned with the second rail system 262. Such alignment is a consequence of the use of identical panels 234 to form the second and fourth rail systems 262 and 314. In the embodiment shown in FIGS. 1-3, the second and fourth pluralities have a single shared member: the bollard post 284, which serves as the fourth bollard post in the second plurality and as the seventh bollard post in the fourth plurality. This configuration places the second and fourth rail systems 262 and 314 in abutting relationship.

In other embodiments of the invention, not shown in the Figures, the second and fourth pluralities of posts may have an overlapping membership of two or more posts. Such a configuration will cause the second and fourth rail systems to partially coincide, with one or more rails serving in both systems. In such an embodiment, the second cable passageways should be enlarged, or an additional cable passageway formed, in order to permit passage of two cables through the intermediate posts which support both rail systems. In yet other embodiments, there may be no overlap in membership between the second and fourth pluralities of posts.

In the embodiment shown in FIGS. 1-3, the third and fourth pluralities are characterized by equal numbers of posts 202, namely 9, with 5 posts belonging to both pluralities. This configuration results in a horizontal offset of the fourth rail system 314 in relationship to the third rail system 300, such that the midpoint of the third rail system 300 is vertically aligned with an endpoint of the fourth rail system 300. In other embodiments, the third and fourth pluralities of posts may be identical, which will result in vertical alignment of the third and fourth rail systems 300 and 314 at both of their respective endpoints. In such an embodiment, the fifth anchor substrate preferably also serves as the seventh anchor substrate, and the sixth anchor substrate preferably also serves as the eighth anchor substrate. In yet other embodiments, the third and fourth pluralities of posts may comprise unequal numbers of posts.

The fence 200 may be provided with additional rail assemblies, preferably formed from panels 234 which are supported by additional pluralities of posts. The number of posts in each additional plurality is preferably equal to the number of posts in the first plurality. The additional pluralities of posts are selected, configured and arranged in substantially the same manner as described with reference to FIGS. 1-3, as are the rail systems supported thereon. Rail cable assemblies, having substantially the same construction and configuration as described with reference to FIGS. 1-3, may be installed in these rail systems. Preferably, the pluralities of posts which define immediately adjoining aligned rail systems share only post, comprising a bollard post.

In the embodiment shown in FIGS. 1-3, the vertically offset rail systems defined in the first and second intermediate rails 236 and 238 are horizontally staggered, so that the endpoint of a rail system in one intermediate rail is aligned with the midpoint of a rail system in the other intermediate rail. Such a staggered configuration is preferably not maintained at the terminus or termini of the fence 200, however, because it will leave one of the intermediate rails without cabling at the terminus. For example, in FIGS. 2 and 3, the first rail system 260 terminates at first bollard post 252, while the staggered second rail system 262 terminates at third bollard post 280. The second intermediate post 238 of panels 234 between first bollard post 252 and third bollard post 280 are not a part of either of these staggered rail systems.

In order to provide a strengthening cable in each intermediate rail adjacent the first bollard post, the second plurality of posts and the second rail system may be enlarged, with the first bollard post and fourth bollard post serving as its terminal posts. A longer second cable is used, and anchored adjacent its first end at the first bollard substrate, rather than the third bollard substrate.

Alternately, as shown in FIGS. 2, 3 and 21, a fifth rail system 316 may be defined by the second intermediate rails 238 of the panels 234 installed between the first bollard post 252 and the third bollard post 282. A fifth cable 318, having a length less than that of the first cable 264, is installed in the fifth rail system 316. The fifth cable 318 is anchored adjacent each of its respective ends by the first anchor substrate and the third anchor substrate. Other details about the construction and arrangement of these components are the same as described with reference to corresponding components of the first rail system 360 and first rail cable assembly.

In the embodiment described with reference to FIGS. 1-3, rail cable assemblies are installed in two of the rail systems supported by each numbered plurality of posts. In another embodiment of the invention (not shown), a rail cable assembly may be installed in only one of these rail systems. In yet other embodiments, also not shown, rail cable assemblies may be may be installed in more than two of these rail systems, or in all of the rail systems supported by a numbered plurality of posts.

The fence 200 of the present invention includes several features which cooperate to increase the resistance of the fence 200 to penetration by a moving vehicle. The anchored cables installed within the spaced rail systems (e.g., the first and second rail systems 260 and 262), will strengthen these rail systems against rupture by vehicular impact. At the same time, the multiple pickets 43 which interconnect the cabled rail systems provide a structure which maintains the vertical positioning of these rail systems, and their installed strengthening cables, throughout the fence 200. This structure tends to resist any widening of the space between adjacent rail systems and cables, thereby enhancing the difficulty of penetration.

Another resistivity-enhancing feature of the fence 200 is provided when adjacent cable-bearing rail systems in each panel 234 are horizontally offset, as shown in FIGS. 1-3. Such a construction assures that the adjacent strengthening cables in each panel 234 are anchored by different anchor substrates (except possibly at the terminal zones of the fence). Even if one cable assembly extending through a panel 234 were to be penetrated as a result of an impact, the adjacent cable assembly extending through in the same panel 234 may survive, because it is anchored by a separate pair of anchor substrates.

In order to assemble the fence 200, a plurality of spaced holes are formed in the terrain 205. Adjacent holes should be spaced at a separation distance which equals the desired spacing of posts 202 in the assembled fence 200, as shown in FIGS. 1-3. Holes which are to receive a bollard substrate, such as the first bollard substrate 254, preferably are formed with a depth of 5 feet and a diameter of 3 feet. Holes which are to receive a upright substrate 210, preferably are formed with a depth of 3 feet and a diameter of 9 inches.

Each of the bollard posts 204 and upright posts 208 comprising the first plurality of posts is vertically positioned in its respective hole. Each bollard post 204 should be unfilled at this stage of the assembly process, and oriented so that its open end, and covering cap 232, are uppermost and above ground. Once the posts 202 are oriented vertically, a hard substrate is formed within each of the holes, thereby surrounding the lower portions of the post situated therein. Preferably, the substrate is formed by filling unused space within the hole with a fluid filler material, such as 6,000 psi concrete, which hardens to form the substrate.

Once the bollard substrates 206 and upright substrates 210 have been formed, connectors (either fish plates or end brackets) are installed on each of the posts 202, and a panel 234 is installed between each adjacent pair of posts. An end of first cable 264 is held in a fixed position at or near one of the terminal posts, and the other end of the cable is then drawn through the first cable passageway of each intermediate post and thence toward the other terminal post. When any intermediate post comprises a bollard post 204, the first cable 264 is passed through the bollard post 204 by way of the pair of first cable openings 218 formed in the first slot covers 216, as shown in FIG. 21. A medial portion of first cable 264 is thereby positioned within that portion of the first rail system 260 supported by the intermediate posts.

The first slot covers 216 of the first and second bollard posts 252 and 256 are removed. If the first slot cover 216 is characterized by a central cable opening, the first end 266 of the first cable 264 is threaded through the first cable opening 218 of the first slot cover 216 from first bollard post 252. The first slot cover 216 is moved along the first cable 264 to a position spaced from the first end 266, and the first anchors 270 are then attached to first cable 264 at spaced locations along the first cable 264 between the first slot cover 216 (if one is installed) and the first end 266. If the first slot cover 216 from second bollard post 256 is characterized by a central cable opening, it is similarly installed on the first cable 264 at its second end 268. Second anchors 276 are next attached to first cable 264 at spaced locations along the first cable 264 between the first slot cover 216 (if one is installed) and the second end 268.

The first end 266 of the first cable 264 is next fed through the open first anchor slot 312 of the first bollard post 252, and into the hollow interior thereof. That portion of the first cable 364 bearing the first anchors 270 is in turn fed through the first anchor slot 312, which is sized to clearingly receive the first anchors 270. Feeding of the first cable 264 continues until the first end 266 is positioned adjacent the base of the first bollard post 254, as shown in FIG. 18. The first slot cover 216 is then reinstalled over the first anchor slot 312. The first cable 264 now extends out of the first bollard post through the first cable opening 218.

The second end 268 of the first cable 264, and its associated second anchors 276 are similarly installed through the first anchor slot 216 of the second bollard post 256. As thus configured, the first cable 264 is under no tension other than that resulting from the gravitational forces on the depending portions of the first cable 264 within each terminal posts. The same steps should then be repeated for each additional rail cable assembly which will be housed in any rail system supported in whole or part by the first plurality of posts.

Once medial portions of the cables have been positioned in their respective rail systems, and once the anchors and their associated cable ends have been installed into their bollard posts 204, then each of the bollard posts 204 in the first plurality is filled, at least partially and preferably completely, with ballast 230. The anchor-bearing portion of the cable within the bollard post 204 becomes embedded in the ballast 230

Preferably, the ballast 230 is introduced into each bollard post 204 through its open upper end, after removing cap 232. The slot covers formed in each bollard post 204 serve to partially or completely prevent the flow of ballast out of the post through the anchor slots. Following installation of the ballast 230, the cap 232 is reinstalled. A preferred ballast 230 is a concrete with relatively high compressive strength, such as 6,000 pounds per square inch. Vibrators are preferably used to produce concrete of a uniform consistency and distribution within each bollard post 204.

As discussed above, each cable passageway which extends through a bollard post 204 preferably comprises a linear passage through the ballast 230. This linear passage registers at each of its ends with a first cable opening 218 or second cable opening 222. This cable passageway forms when a terminal post is filled with ballast 230, and corresponds to the space within the terminal post occupied by the cable which extends between the opposed cable openings of the terminal post.

Additional posts, rail systems and cable assemblies may be installed in the fence 200 by following substantially the same series of steps described above.

The fence 200 may be assembled from, and the assembly method advantageously practiced with, a kit. The kit of the present invention preferably comprises a plurality of anchorable posts, preferably identical to the posts 202. More preferably, the kit includes at least one, and preferably two terminal posts, and at least one, and preferably a plurality of intermediate posts. Each of the intermediate posts comprising the kit preferably is characterized by at least a first cable passageway extending therethrough. If the kit is to be used to assemble a fence having multiple cable assemblies within a panel, such as the panel 234, then the number of cable passageways formed in each post should be sufficient to accommodate the requisite number of cable assemblies. The posts are preferably provided in a number sufficient to form the fence, or section thereof, to be installed.

The kit further comprises a first cable which is extensible through the first cable passageways of the posts which comprise the kit, preferably further comprises a second cable which is extensible through the second cable passageways of the posts which comprise the kit. The first and second cables are preferably identical to the first and second cables 264 and 278. The cable for the kit may be provided in the form of an uncut elongate cable, but more preferably is provided in the form of a plurality of precut cable segments, each of a length sufficient to form a rail cable assembly required for the fence, or section thereof, to be installed. In the event that the kit includes uncut cable, that cable must be cut into cable segments of appropriate length prior to their installation into the fence or section thereof.

If the kit comprises precut cable segments, it should include such segments (e.g., a third cable and a fourth cable) in a number sufficient to provide all of the cable assemblies required in the fence, or section thereof, to be installed. The length of each cable segment should sufficient to extend through its rail system and span the distance between the anchor substrates in which it will be installed. In general, segment length will vary depending on the vertical height of the rail assembly in which it will be carried, with greater segment length required for rail assemblies of greater vertical height. If the kit comprises one or more uncut elongate cables, these cables should have a length sufficient to permit cutting therefrom of all of the cable segments required to form the fence, or section thereof, to be installed.

The kit further comprises at least a first pair of anchors, preferably identical to the first anchor 270 and second anchor 276. Each anchor should be attachable to a segment of cable adjacent one of its ends to form a rail cable assembly. Preferably, the kit comprises a plurality of pairs of anchors, provided in a number sufficient to provide two anchor assemblies for each cable required for the fence, or section thereof, to be installed. In the embodiment shown in FIGS. 1-23, each anchor assembly comprises four anchors, so four pairs of anchors would be provided for each cable required.

The kit further comprises a plurality of cable connectors, such as the 272, for connecting the cable to its respective anchors adjacent each cable end. Preferably, the kit comprises such connectors in a number sufficient to secure the requisite number of anchors to each cable required for the fence, or section thereof, to be installed.

The kit further comprises a plurality of elongate rails, each having an internal recess formed therein within which a cable may extend, such as the rails 42. The rails 42 of the kit are preferably configured as panels, each preferably identical to the panel 234, with each panel comprising a plurality of elongate rails and a plurality of pickets. which is formed from assembled rails and pickets. Each such panel should comprise at least one and preferably a plurality of parallel rail systems which traverse the space between an adjacent pair of posts. Each such rail system should have an internal recess formed therein within which the cable may extend. The panels should be provided in a number sufficient to provide the rail systems required for the fence 200, or section thereof, to be installed.

The kit preferably further comprises a plurality of connectors, preferably identical to the fish plates 90 and end brackets 96, for installation on the posts and connection to the panels. The kit preferably further comprises a plurality of fasteners, for securing the ends of the rails of the panels to the connectors. The connectors and fasteners should be provided in a number sufficient to permit assembly of the panels into the rail systems required for the fence, or section thereof, to be installed.

In this disclosure and in the claims which follow, ordinal numbers, such as "first," "second" and "third," have been used to designate various features of the invention. These ordinal numbers have been used for convenience and clarity of description, and not for purposes of enumeration. Thus, for example, reference to a "fifth" anchor does not presuppose the existence of first, second, third or fourth anchors, except to the extent expressly stated herein.

Changes may be made in the construction, operation and arrangement of the various parts, elements, steps and procedures described herein without departing from the spirit and scope of the invention as defined in the following claims.

The invention claimed is:

1. A fence having a base, the fence situated on a terrain and comprising:

a first terminal post at least partially filled with ballast;

a first underground substrate within which the first terminal post is embedded, the first underground substrate defining an external ground-contacting contour;

a second terminal post spaced from the first terminal post and at least partially filled with ballast;

a second underground substrate spaced from the first underground substrate and defining an external ground-contacting contour; and a first unitary cable extending between the first and second terminal posts and having a first end and a second end;

in which the first cable extends substantially vertically within the first terminal post adjacent the first end of the first cable, and in which the first end is situated at an underground position within the external contour defined by the first underground substrate.

2. The fence of claim 1 in which the first cable extends substantially vertically within the second terminal post adjacent the second end of the first cable, and in which the second end is situated at an underground position within the external contour defined by the second underground substrate.

3. The fence of claim 1 in which the first end of the first cable is embedded within the ballast within the first terminal post.

4. The fence of claim 1, further comprising;

a first anchor attached to the first cable adjacent the first end of the first cable.

5. The fence of claim 4 in which the first terminal post has a lateral portion having a first anchor slot formed therein, the first anchor slot sized to closely but clearingly receive the first anchor therethrough.

6. The fence of claim 1, further comprising:

a plurality of spaced first intermediate posts situated between the first and second terminal posts, the first intermediate posts situated in a series of adjacent pairs;

a first rail system formed from a plurality of longitudinally aligned rails, the first rail system supported by the first intermediate posts so as to form a barrier between each adjacent pair of first intermediate posts.

7. The fence of claim 6 in which the first rail system is supported by the first and second terminal posts, so as to form a barrier between the first terminal post and one of said first intermediate posts adjacent the first terminal post and between the second terminal post and one of said first intermediate posts adjacent the second terminal post.

8. The fence of claim 6 in which at least one of the said first intermediate posts has a first cable passageway extending therethrough, and in which the first cable extends through the first cable passageway of the at least one first intermediate post.

9. The fence of claim 6, further comprising:

a plurality of spaced second intermediate posts situated on a side of the second terminal post opposite the first terminal post, the second intermediate posts situated in a series of adjacent pairs;

a second rail system formed from a plurality of longitudinally aligned rails, the second rail system aligned with the first rail system and supported by the second intermediate posts and second terminal post so as to form a barrier between each adjacent pair of second intermediate posts, and between the second terminal post and one of said second intermediate posts adjacent the second terminal post.

10. The fence of claim 6, further comprising:

a plurality of pickets, each picket situated intermediate each adjacent pair of first intermediate posts, each of said pickets extending in transverse relationship to the first rail system and having a lower end situated above and in close proximity to the terrain, and an upper end.

11. The fence of claim 6 in which each of said rails forming the first rail system has a longitudinal internal recess formed therein, and in which the first cable extends within at least a portion of the internal recess of at least one of said rails.

12. The fence of claim 1, further comprising:

a second cable extending between the first and second terminal posts in vertically offset relationship to the first cable, the second cable having a first end and a second end;

in which the second cable extends substantially vertically within the first terminal post adjacent the first end of the second cable, and in which the first end of the second cable is situated at an underground position within the external contour defined by the first underground substrate.

13. The fence of claim 12 in which the second cable is situated between about 44 inches and about 52 inches above the base of the fence.

14. The fence of claim 13 in which the second cable is situated about 48 inches above the base of the fence.

15. The fence of claim 12 in which the first cable is situated between about 30 inches and about 38 inches above the base of the fence and in which the second cable is situated between about 44 inches and about 52 inches above the base of the fence.

16. The fence of claim 15 in which the second cable is situated about 48 inches above the base of the fence.

17. The fence of claim 12 in which the first cable is situated about 34 inches above the base of the fence and in which the second cable is situated about 48 inches above the base of the fence.

18. The fence of claim 1 in which the first cable is situated between about 30 inches and about 38 inches above the base of the fence.

19. The fence of claim 18 in which the first cable is situated about 34 inches above the base of the fence.

20. The fence of claim 1 in which each terminal post is a hollow tubular structure.

* * * * *